US008409009B2

(12) United States Patent
Motyl et al.

(10) Patent No.: US 8,409,009 B2
(45) Date of Patent: Apr. 2, 2013

(54) PERIPHERAL UPDATE PERIPHERAL IN A WAGERING GAME SYSTEM

(75) Inventors: Jim Motyl, Chicago, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 1145 days.

(21) Appl. No.: 12/304,229

(22) PCT Filed: Jun. 13, 2007

(86) PCT No.: PCT/US2007/013837

§ 371 (c)(1),
(2), (4) Date: Dec. 10, 2008

(87) PCT Pub. No.: WO2007/146316

PCT Pub. Date: Dec. 21, 2007

(65) Prior Publication Data

US 2009/0270176 A1 Oct. 29, 2009

Related U.S. Application Data

(60) Provisional application No. 60/804,641, filed on Jun. 13, 2006, provisional application No. 60/822,433, filed on Aug. 15, 2006.

(51) Int. Cl.
*A63F 9/24* (2006.01)

(52) U.S. Cl. ..... 463/42; 463/20; 717/170; 717/173

(58) Field of Classification Search ..... 463/42, 463/20; 717/170, 173
See application file for complete search history.

(56) References Cited

U.S. PATENT DOCUMENTS

| | | | | |
|---|---|---|---|---|
| 5,707,286 | A | 1/1998 | Carlson | |
| 5,759,102 | A | 6/1998 | Pease et al. | |
| 6,135,887 | A | 10/2000 | Pease et al. | |
| 6,263,392 | B1 * | 7/2001 | McCauley | 710/305 |
| 6,899,627 | B2 | 5/2005 | Lam et al. | |
| 6,908,391 | B2 | 6/2005 | Gatto et al. | |
| 6,979,266 | B2 | 12/2005 | Lemay et al. | |
| 6,997,803 | B2 | 2/2006 | LeMay et al. | |
| 7,143,406 | B2 * | 11/2006 | Kenyon et al. | 717/173 |
| 7,727,071 | B2 * | 6/2010 | Giobbi | 463/42 |
| 7,785,204 | B2 * | 8/2010 | Wells et al. | 463/42 |

(Continued)

OTHER PUBLICATIONS

"International Application Serial No. PCT/US2007/13837, International Search Report and Written opinion mailed Sep. 15, 2008", 9 pgs.

(Continued)

*Primary Examiner* — N Drew Richards
*Assistant Examiner* — John P Dulka
(74) *Attorney, Agent, or Firm* — Schwegman Lundberg & Woessner, P.A.

(57) ABSTRACT

There is provided a peripheral update device. The peripheral update device includes at least one interface adapted to communicatively connect to at least one peripheral device of a wagering game machine and to an update device, the at least one interface adapted to receive a firmware update from the update device for a peripheral device of the at least one peripheral device. The peripheral update device further includes a processor being communicatively connected to the at least one interface and adapted to receive the transmitted firmware update via the at least one interface and further adapted to apply the received firmware update to the peripheral device via the at least one interface.

23 Claims, 13 Drawing Sheets

U.S. PATENT DOCUMENTS

| | | | | |
|---|---|---|---|---|
| 2002/0147047 | A1 | 10/2002 | Letovsky et al. | |
| 2004/0082385 | A1 | 4/2004 | Silva et al. | |
| 2004/0254006 | A1* | 12/2004 | Lam et al. | 463/16 |
| 2004/0254013 | A1 | 12/2004 | Quraishi et al. | |
| 2006/0068920 | A1 | 3/2006 | Lemay et al. | |
| 2006/0199645 | A1 | 9/2006 | Canterbury et al. | |
| 2007/0159650 | A1 | 7/2007 | Takamatsu et al. | |
| 2007/0226448 | A1* | 9/2007 | Hirayama | 711/170 |
| 2007/0265967 | A1* | 11/2007 | Kahn et al. | 705/51 |
| 2007/0298862 | A1* | 12/2007 | Kidneigh | 463/20 |
| 2008/0076558 | A1* | 3/2008 | Okada | 463/36 |
| 2008/0254739 | A1* | 10/2008 | Kidd et al. | 455/3.01 |

OTHER PUBLICATIONS

"3rd Generation Partnership Project; Technical Specification Group Services and System Aspects; Speech Codec List for GSM and UMTS: (Release 1999)", 3GPP TS 26.103 V3.2.0 (Jun. 2002) Technical Specification, GSM: Global System for Mobile Communications, (2002), 12 pgs.

* cited by examiner

PERIPHERAL UPDATE PERIPHERAL IN A WAGERING GAME SYSTEM

RELATED APPLICATIONS

This patent application is a U.S. National Stage Filing under 35 U.S.C. 371 from International Patent Application Serial No. PCT/US2007/013837, filed Jun. 13, 2007, and published on Dec. 21, 2007, as WO 2007/146316 A2, which claims the priority benefit of U.S. Provisional Patent Application Ser. No. 60/804,641 filed Jun. 13, 2006 and entitled "PERIPHERAL UPDATE PERIPHERAL IN A WAGERING GAME SYSTEM", and to U.S. Provisional Patent Application Ser. No. 60/822,433 filed Aug. 15, 2006 and entitled "PERIPHERAL UPDATE PERIPHERAL IN A WAGERING GAME SYSTEM", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

TECHNICAL FIELD

This application relates generally to wagering game systems. More particularly, example embodiments are directed to a peripheral update peripheral adapted to update one or more peripheral devices of a wagering game machine in a wagering game network.

BACKGROUND

Wagering game machine developers continually provide new and entertaining games. One way of increasing entertainment value associated with casino-style wagering games (e.g., video slots, video poker, video blackjack, and the like) includes offering a variety of base games and bonus events. However, despite the variety of base games and bonus events, players often lose interest in repetitive wagering gaming content. In order to maintain player interest, wagering game machine developers frequently update wagering game content with new game themes, game settings, bonus events, game software, and other electronic data.

When distributing new wagering game content to wagering game machines in the field, wagering game machine operators typically manually deliver the content to each wagering game machine. For example, when deploying new wagering game content, operators typically replace existing media (e.g., ROM, CD-ROM, or flash RAM) with new media containing updated wagering game content. For wagering game machine operators owning scores of machines, this process may be relatively laborious and expensive.

BRIEF DESCRIPTION OF THE DRAWINGS

Embodiments are illustrated by way of example and not limitation in the figures of the accompanying drawings in which.

DETAILED DESCRIPTION

Figure 1A:
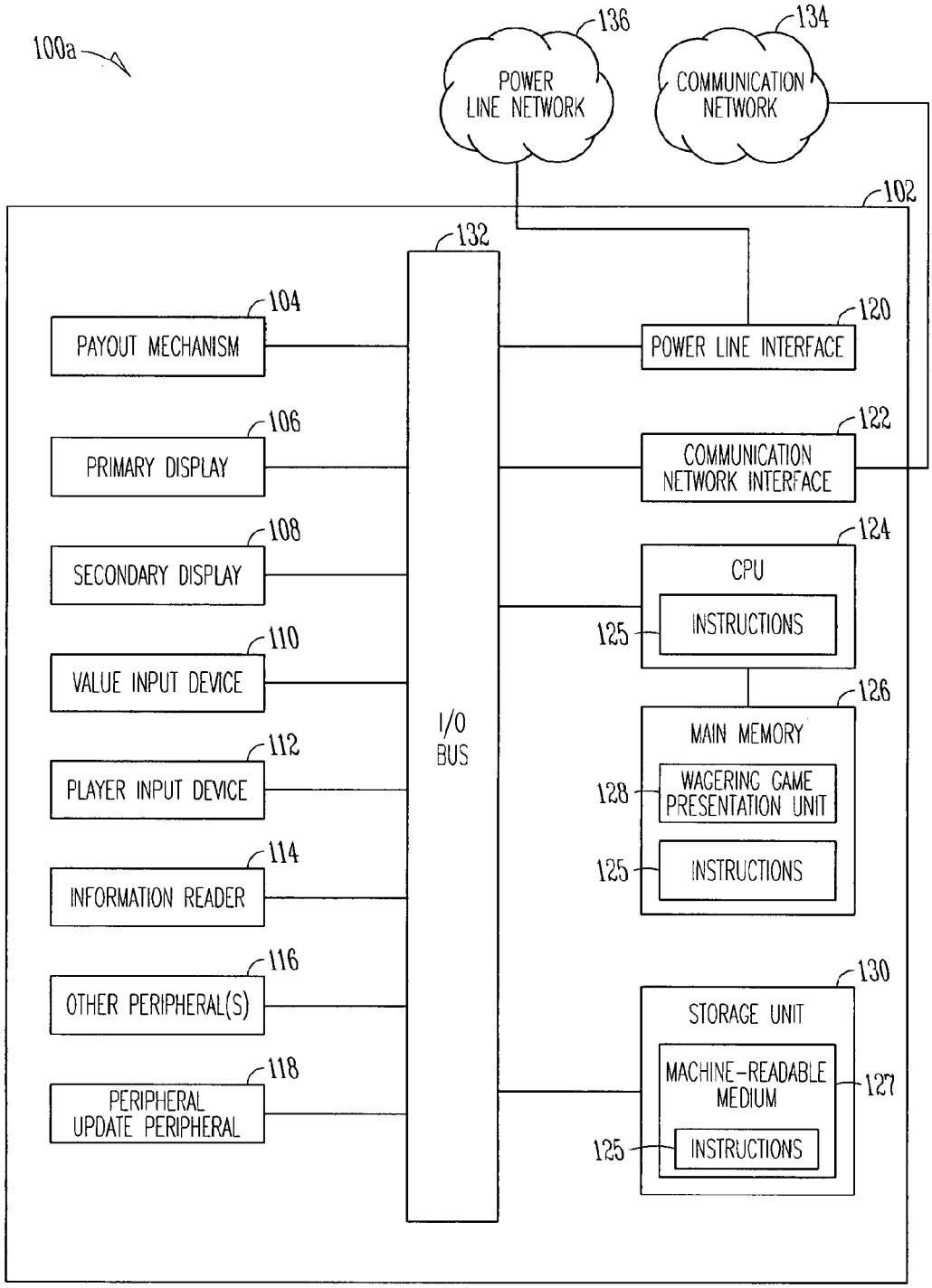
FIG. 1A is a block diagram illustrating an embodiment of an example wagering game machine architecture including a peripheral update peripheral adapted to update one or more peripheral devices of the wagering game machine.

FIG. 1A is a block diagram illustrating an embodiment of an example wagering game machine architecture 100*a* including a peripheral update peripheral 118 adapted to update one or more peripheral devices 104-116 of the wagering game machine 102. The wagering game machine 102 includes a central processing unit (CPU) 124 communicatively connected to main memory 126, which includes a wagering game presentation unit 128. The wagering game presentation unit 128 may present wagering games, such as video poker, video blackjack, video slots, video lottery, and the like, in whole or in part. The CPU 126 is also communicatively connected to an input/output (I/O) bus 132, which facilitates communication between the CPU 126 and other components of the wagering game machine 102. The storage unit 130 may store the aforementioned wagering games for execution by the CPU 124 and presentation by the wagering game presentation unit 128. The I/O bus 132 is further communicatively connected to multiple peripheral devices including a payout mechanism 104, a primary display 106, secondary display 108, a value input device 110, a player input device 112, an information reader 114, one or more other peripheral devices 116. It is to be noted that the peripheral devices may include a bill validator, a printer, a coin hopper, a button panel, or any of the many peripherals now found in wagering game machines or developed in the future. The player input device 112 may include the value input device 110 to the extent the player input device 112 is used to place wagers.

Further with reference to FIG. 1A, the I/O bus 132 is communicatively connected to a power line interface 120 that provides an interface to the wagering game machine 102 for communication over a power line network 136, as will be described in greater detail below with reference to FIG. 4. The power line network 136 is a physical medium which is used to distribute alternating current (AC) to power the wagering game machine 102 and which may be used to provide a medium for data communication. More specifically, the power line interface 120 of the wagering game machine 102 may encode data onto and decode data from the power line network 136 to facilitate the data communication. The encoding may be accomplished by placing a carrier signal onto the AC current of the power line network 136. The carrier signal may be modulated using frequency modulation or amplitude modulation to encode the data communication onto the AC current. The decoding may be accomplished by processing the carrier signal to extract the data communication.

Still further with reference to FIG. 1A, the I/O bus 132 is also communicatively connected to a communication network interface 122 that provides an interface to the wagering game machine 102 for communication over a communication network 134, as will be described in greater detail below with also reference to FIG. 4. The communication network 134 may be any conventional network, including the Internet, Wide Area Network (WAN), Metropolitan Area Network (MAN), Campus Area Network (CAN), Local Area Network (LAN), Home Area Network (HAN), wireless (802.11), satellite, as well as a variety of different combinations thereof. Furthermore, one or more of the communication network 134 and the power line network 136 may form a part of a wagering game network, as will further be described in greater detail below with reference to FIG. 4. It is to be noted that the wagering game machine 102 may include multiple power line interfaces 120 and communication network interfaces 122, as well as multiple CPUs 124. Any of the components of the wagering game machine 102 that were described above may be integrated or subdivided. Additionally, the components of the wagering game machine 102 may be communicatively interconnected according to any suitable interconnection architecture, including interconnections described hereinafter with reference to FIGS. 2B-2C and 7A-7C.

Yet further with reference to FIG. 1A, the wagering game machine architecture 100*a* includes instructions 125 for causing the wagering game machine 102 to perform any one or more of the methodologies described herein. Furthermore, the storage unit 130 includes a machine readable medium 127 on which there is stored one or more sets of instructions and/or data structures (e.g., software 125) embodying or utilized by any one or more of the methodologies described herein. The software 125 may also reside, completely or at least partially, within the main memory 126 and/or within the CPU 126 during execution thereof by the wagering game machine 102, the main memory 126 and the CPU 124 also constituting machine-readable media. The software 125 may further be transmitted or received over the communication network 134 and the power line network 136.

Lastly with reference to FIG. 1A, the wagering game machine 102 includes a peripheral update peripheral (PUP) 118, which is communicatively connected to the I/O bus 132 and which is adapted to update one or more peripheral devices 104-116 of the wagering game machine 102. The details of the PUP 118 will be described hereinafter in greater detail with reference to FIG. 3. However, the PUP 118 is a device that may facilitate firmware updates of one or more peripheral devices 104-116 of the wagering game machine 102, mitigating the utilization of the CPU 122 in the wagering game machine 102. In the architecture 100*a*, the PUP 118 may be enabled to communicate over the power line interface 120, the communication network interface 122 or a wireless interface (FIG. 3) to receive firmware updates from and transmit status updates to an update server (FIG. 4) over the power line network 136 and/or the communication network 132, respectively. Alternatively, the CPU 124 may receive firmware updates over the power line network 136 and/or the communication network 132, respectively, and may then transmit the firmware updates to the PUP 118 to update one or more peripheral devices 104-116 of the wagering game machine 102. These processes of updating one or more peripheral devices 104-116 of the wagering game machine 102 are described in greater detail below with reference to FIGS. 8 and 9.

Figure 1B:
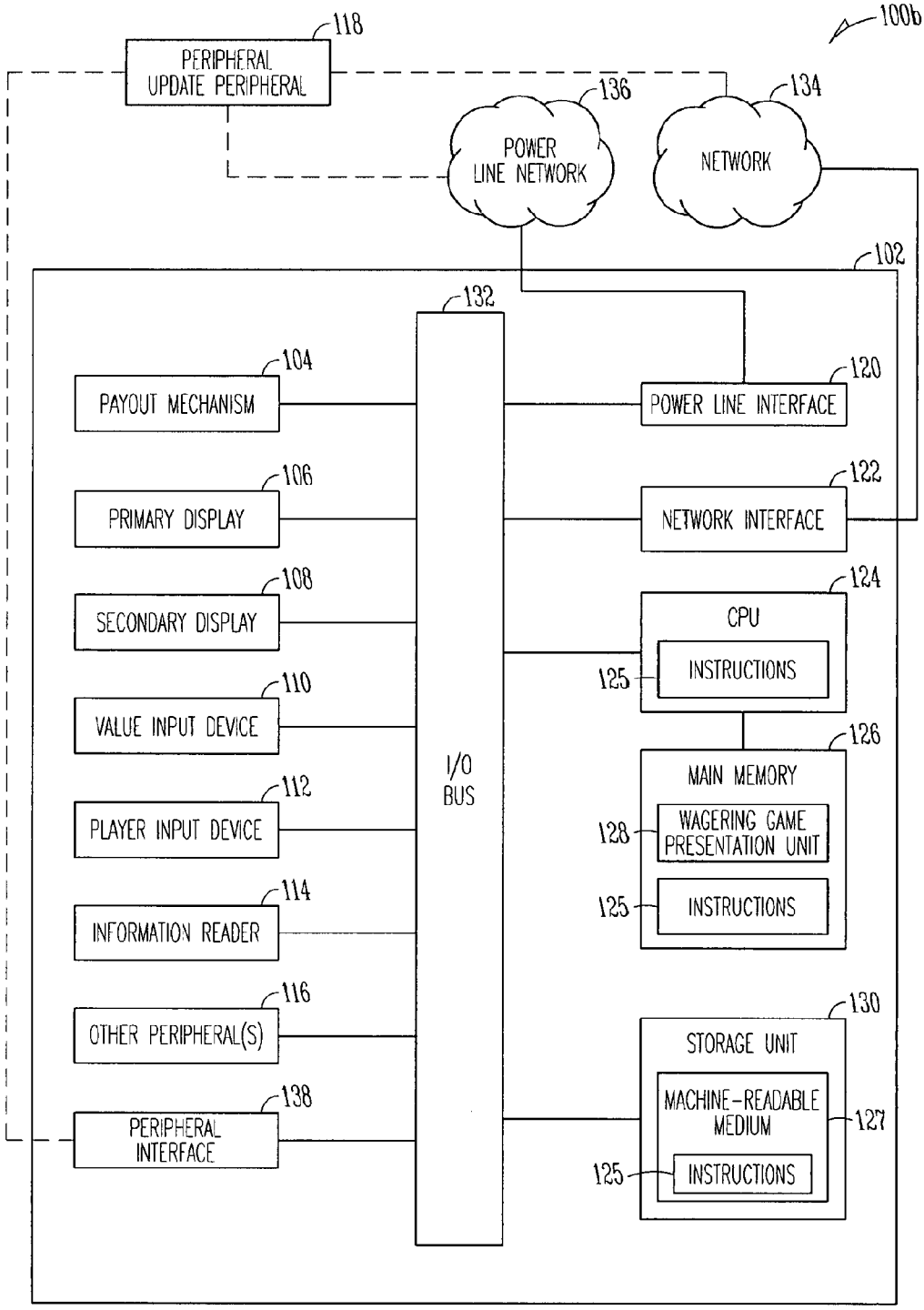
FIG. 1B is a block diagram illustrating an embodiment of an example wagering game machine architecture including an input/output (I/O) bus communicatively connecting one or more peripheral devices of the wagering game machine via a peripheral interface to an external peripheral update peripheral adapted to update the one or more peripheral devices of the wagering game machine.

FIG. 1B is a block diagram illustrating an embodiment of an example wagering game machine architecture 100*b* including an I/O bus 132 communicatively connecting one or more peripheral devices 104-116 of the wagering game machine 102 via a peripheral interface 140 to an external peripheral update peripheral 118 adapted to update the one or more peripheral devices of the wagering game machine. In this embodiment, the PUP 118 may be external to the wagering game machine 102 and may facilitate firmware updates in the wagering game machine 102, mitigating the utilization of the CPU 122 in the wagering game machine 102. More specifically, the peripheral interface 140 communicatively connects the external PUP 118 to the I/O bus 132 to which other components of the system are communicatively connected, thereby facilitating communication between there foregoing components and the PUP 118. The peripheral interface 138 may support a universal serial bus (USB) connection or FIREWIRE® connection (IEEE 1394) for interfacing the PUP 118 to the I/O bus 132, or wireless variants thereof (e.g., wireless USB). Alternate connections now available (e.g., serial connection) or to be designed may easily be implemented. The PUP 118 may be a plug-and-play device and the wagering game machine architecture 100*b* may support plug-and-play devices and hot-plugging, facilitating automatic recognition and connection of the PUP 118 during operation of the wagering game machine 102. The PUP 118 may also be communicatively connected to a communication network 134 and/or a power line network 136 to receive firmware updates from an update server and/or transmit update status to the update server. Alternatively, the CPU 124 may receive firmware updates and may transmit the received firmware updates to the PUP 118. These processes of updating one or more peripheral devices 104-116 of the wagering game machine 102 are described in greater detail below with reference to FIGS. 8 and 9.

Figure 1C:
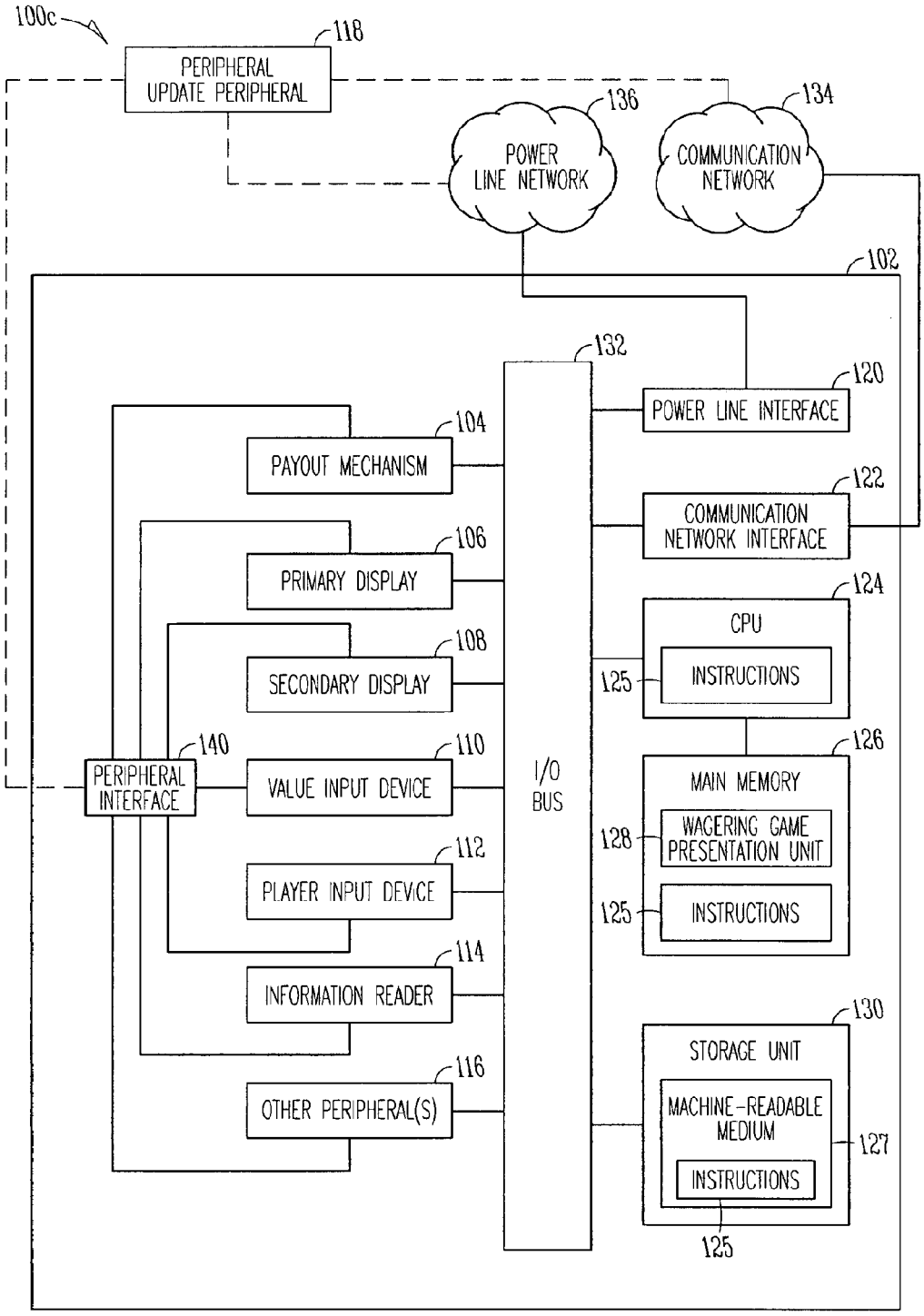
FIG. 1C is a block diagram illustrating an embodiment of an example wagering game machine architecture including a peripheral interface interfacing one or more peripheral devices of the wagering game machine to an external peripheral update peripheral adapted to update the one or more peripheral devices of the wagering game machine.

FIG. 1C is a block diagram illustrating another embodiment of an example wagering game machine architecture 100*c* including a peripheral interface 140 interfacing one or more peripheral devices 104-116 of the wagering game machine 102 to an external peripheral update peripheral (PUP) 118 adapted to update the one or more peripheral devices of the wagering game machine. In this embodiment, the PUP 118 may be external to the wagering game machine 102 and may facilitate firmware updates in the wagering game machine 102, mitigating the utilization of the CPU 122 in the wagering game machine 102. More specifically, a peripheral interface 140 communicatively connects the peripheral devices 104-116 of the wagering game machine 102 to the PUP 118. The peripheral interface 140 may support a universal serial bus (USB) connection, FIREWIRE® connection (IEEE 1394), or wireless variants thereof (e.g., wireless USB), for interfacing the peripheral devices 104-116 to the PUP 118. Alternate connections now available (e.g., serial connection) or to be designed to facilitate connection to the peripheral devices 104-116 of the wagering game machine 102 are also possible. As in other embodiments, the PUP 118 may be a plug-and-play device and the wagering game machine architecture 100*c* may support plug-and-play devices and hot-plugging, facilitating automatic recognition and connection of the PUP 118 during operation of the wagering game machine 102. The PUP 118 may also be communicatively connectable to a communication network 134 and/or a power line network 136 to receive firmware updates from and transmit status updates to an update server. In addition, the PUP may likewise use the communication network 134 and/or a power line network 136 to communicate with the CPU 124 of the wagering game machine 102, which may receive firmware updates and may then transmit the firmware updates to the PUP 118 to update one or more peripheral devices 104-116 of the wagering game machine 102. These processes of updating one or more peripheral devices 104-116 of the wagering game machine 102 are described in greater detail below with reference to FIGS. 8 and 9.

Figure 2A:
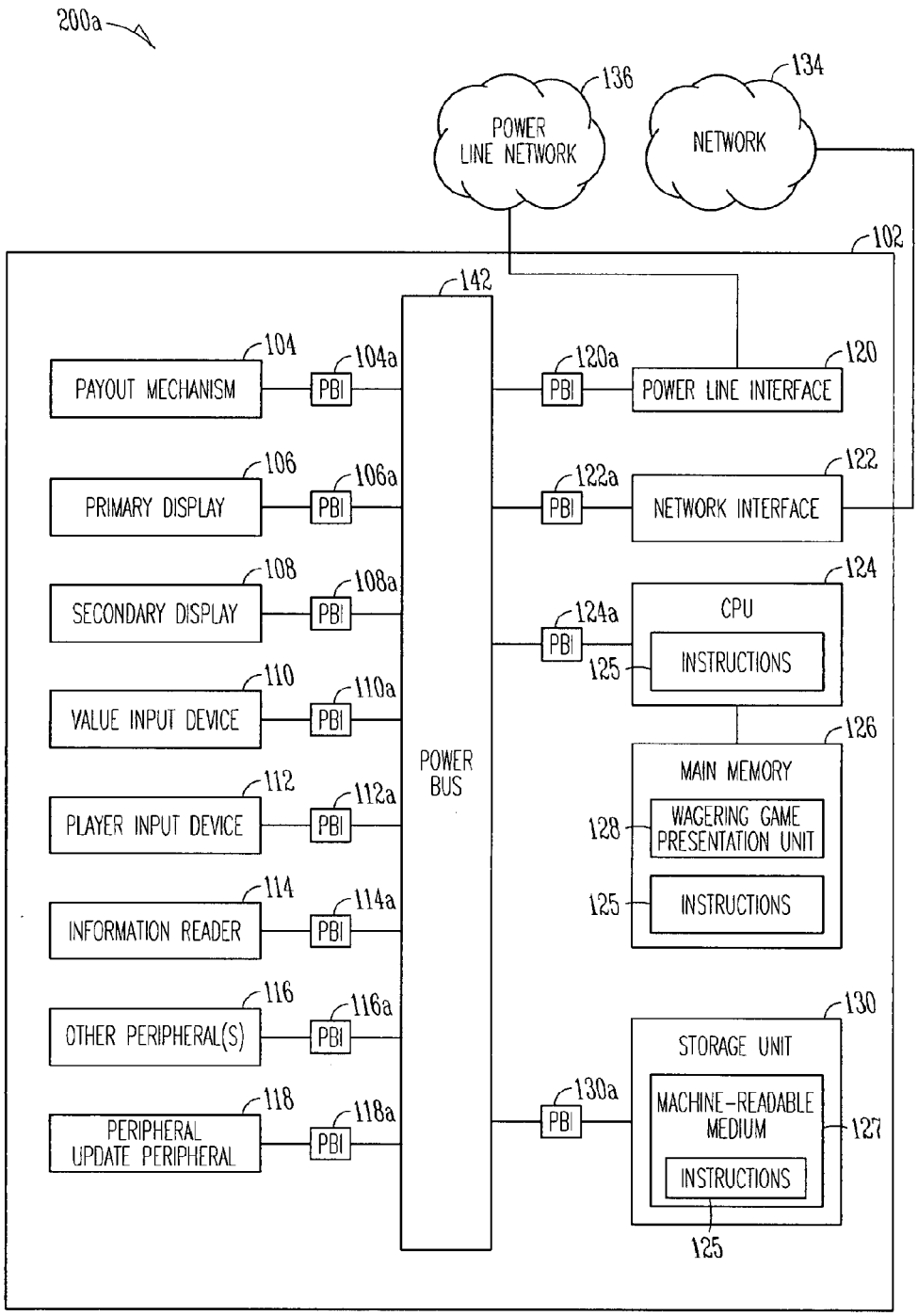
FIG. 2A is a block diagram illustrating an embodiment of an example wagering game machine architecture including a power bus and power bus interfaces connecting respective one or more peripheral devices of the wagering game machine to a peripheral update peripheral adapted to update the one or more peripheral devices of the wagering game machine.

FIG. 2A is a block diagram illustrating an embodiment of an example wagering game machine architecture 200*a* including a power bus 142 and power bus interfaces (PBIs) 104*a*-118*a* communicatively connecting respective one or more peripheral devices 104-118 of the wagering game machine 102 to a peripheral update peripheral (PUP) 118 adapted to update the one or more peripheral devices of the wagering game machine 102. Other components 120-124 and 130 of the wagering game machine 102 may likewise be communicatively connected via respective PBIs 120*a*-124*a* and 130*a* to the power bus 142. The power bus 142 is a physical medium which may be used to distribute direct current (DC) to the aforementioned components of the wagering game machine 102.

Further with reference to FIG. 2A, each of the PBIs 104*a*-118*a* enables a respective associated peripheral device 104-118 to be independently addressable over the power bus 142, facilitating communication between the peripheral devices 104-118 in the wagering game machine 102 and external communication to and from the peripheral devices 104-118 over the communication network 134 and the power line network 136. More specifically, each of the PBIs 104*a*-118*a* is a physically or logically addressable device that communicatively interconnects the respective associated peripheral device 104-118 to the power bus 142. Each of the PBIs 104*a*-118*a* may provide a specific physical connection or coupling to its associated respective peripheral device 104-118 and a physical connection or coupling to the power bus 142. Other components 120-124 and 130 of the wagering game machine 102 may likewise be similarly independently addressable via their respective PBIs 120*a*-124*a* and 130*a*, facilitating communication between components 104-130 in the wagering game machine 102 and external communication over communication network 134 and power line network 136.

Still further with reference to FIG. 2A, the power bus interfaces 104*a*-130*a* may encode data onto and decode data from the DC current of the power bus 140 for facilitating data communication between the various components 104-130 in the waging game machine 102. The encoding may be accomplished by modulating over time a predetermined voltage (e.g., 12V) to values above the predetermined voltage (e.g., 15V), generating a rectangular waveform encoded with the data communication. The decoding may be accomplished by processing the voltage modulation of the rectangular waveform to extract the data communication. Alternatively or in addition, the encoding may be also accomplished by placing a carrier signal onto the DC current of the power bus 140. The carrier signal may my be modulated using frequency modulation or amplitude modulation to encode the data communication onto the DC current. The decoding may be accomplished by processing the carrier signal to extract the data communication. The aforementioned methods for encoding/decoding data may be used simultaneously. Additionally, the methods may be used in conjunction with one another or be used to communicate data for different reasons. For example, the voltage modulation method may be used for communications that do not require constant data communication, while the carrier signal modulation method may be used for communications that require constant data communication.

Finally with reference to FIG. 2A, the PUP 118 may also be enabled to communicate over communication network 134 and/or a power line network 136 to receive firmware updates from an update server and/or transmit update status to the update server. Alternatively, the CPU 124 may receive firmware updates and may transmit the received firmware updates to the PUP 118. These processes of updating one or more peripheral devices 104-116 of the wagering game machine 102 are described in greater detail below with reference to FIGS. 8 and 9.

Figure 2B:
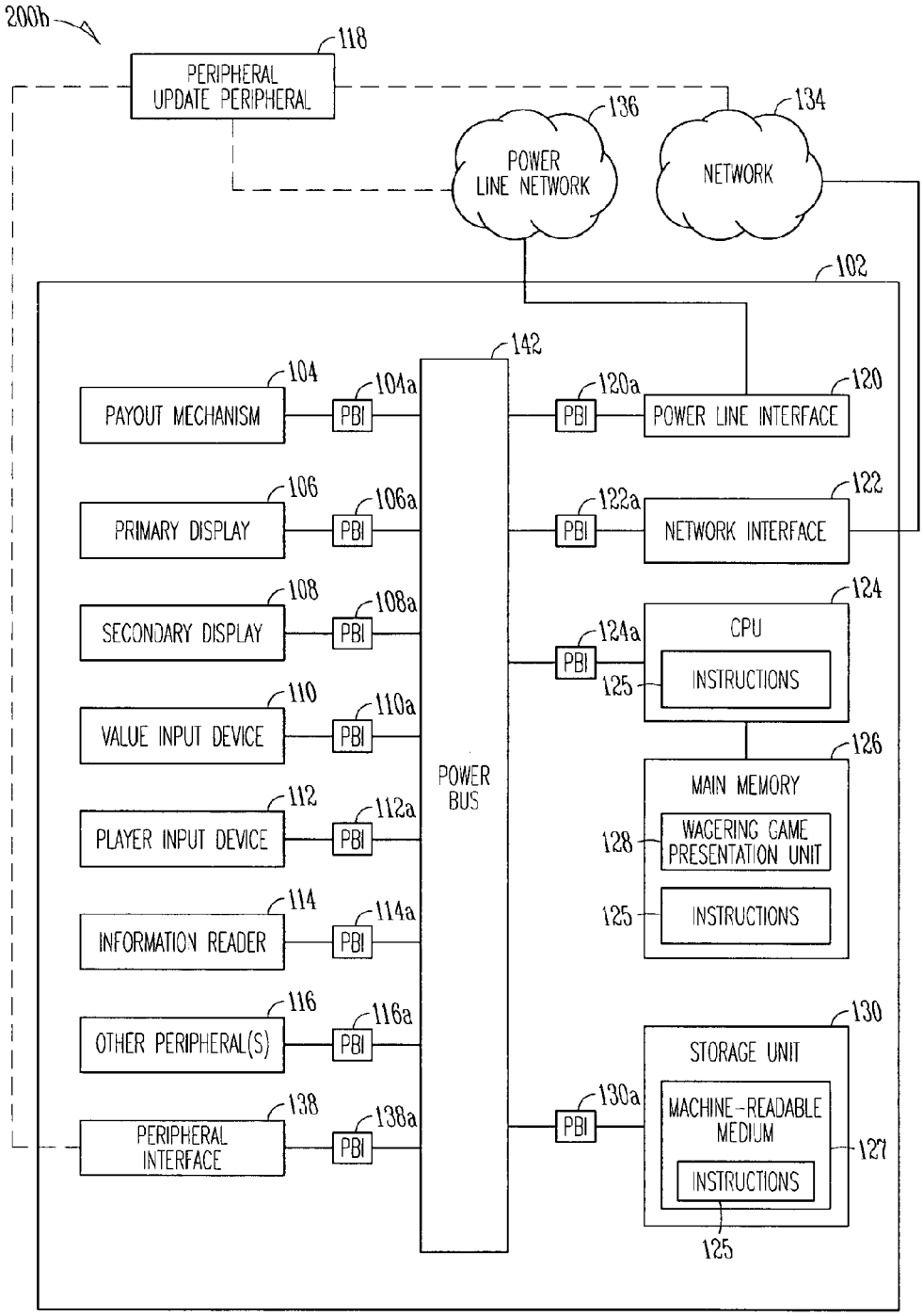
FIG. 2B is a block diagram illustrating an embodiment of a wagering game machine architecture including a power bus and power bus interfaces connecting respective one or more peripheral devices of the wagering game machine via a peripheral interface to an external peripheral update peripheral adapted to update the one or more peripheral devices of the wagering game machine.

FIG. 2B is a block diagram illustrating an embodiment of an example wagering game machine architecture 200*b* including a power bus 142 and power bus interfaces 104*a*-116*a* communicatively connecting respective one or more peripheral devices 104-116 of the wagering game machine 102 via a peripheral interface 138 and power bus interface 138*a* to an external peripheral update peripheral (PUP) 118 adapted to update the one or more peripheral devices 104-116 of the wagering game machine. In this embodiment, the PUP 118 may be external to the wagering game machine 102 and may facilitate firmware updates in the wagering game machine 102, mitigating the utilization of the CPU 122 in the wagering game machine 102. More specifically, the peripheral interface 138 and power bus interface 138*a* communicatively connect the external PUP 118 to the power bus 142 to which other components of the system are communicatively connected via their respective PBIs 104*a*-130*a*, thereby facilitating communication between the foregoing components and the PUP 118 using the power bus 142. As already described above in reference to FIG. 2A, PBIs 104*a*-130*a* facilitate independent addressing of and communication between components 104-130 in the wagering game machine 102 and external communication over communication network 134 and power line network 136. Similarly, PBI 138*a* provides independent addressing to the peripheral interface 138 to which the external peripheral update peripheral 118 may be communicatively connected.

Further with reference to FIG. 2B, the peripheral interface 138 may support a universal serial bus (USB) connection, FIREWIRE® connection (IEEE 1394), or wireless variants thereof (e.g., wireless USB), for interfacing the PUP 118 via PBI 138*a* to the power bus 142. Alternate connections now available (e.g., serial connection) or to be designed may easily be implemented. The PUP 118 may be a plug-and-play device and the wagering game machine architecture 200*b* may support plug-and-play devices and hot-plugging, facilitating automatic recognition and connection of the PUP 118 during operation of the wagering game machine 102. The PUP 118 may also be communicatively connected via its own interfaces (FIG. 3) or via the power bus 142 to a communication network 134 and/or a power line network 136 to receive firmware updates from an update server and/or transmit update status to the update server. Alternatively, the CPU 124 may receive firmware updates and may then transmit the received firmware updates to the PUP 118. These processes of updating one or more peripheral devices 104-116 of the wagering game machine 102 are described in greater detail below with reference to FIGS. 8 and 9.

Figure 2C:
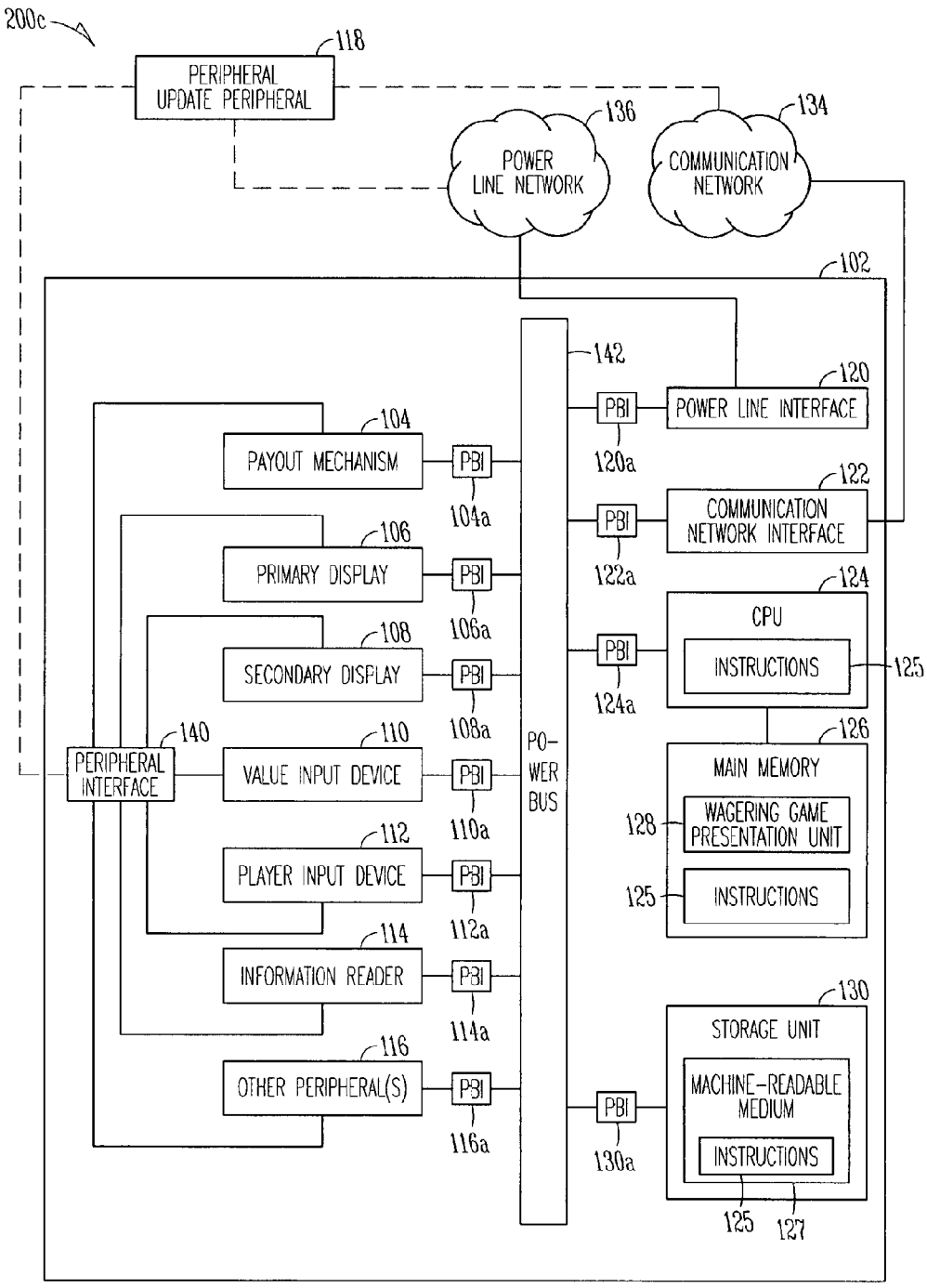
FIG. 2C is a block diagram illustrating an embodiment of an example wagering game machine architecture including a peripheral interface interfacing one or more peripheral devices of the wagering game machine communicatively connected by a power bus to an external peripheral update peripheral adapted to update the one or more peripheral devices of the wagering game machine.

FIG. 2C is a block diagram illustrating an embodiment of an example wagering game machine architecture 200*c* including a peripheral interface 140 interfacing one or more peripheral devices 104-116 of the wagering game machine 102, which are communicatively connected by a power bus 142 and respective power bus interfaces (PBIs) 104*a*-116*a*, to an external peripheral update peripheral (PUP) 118 adapted to update the one or more peripheral devices of the wagering game machine. In this embodiment, the PUP 118 may be external to the wagering game machine 102 and may facilitate firmware updates in the wagering game machine 102, mitigating the utilization of the CPU 122 in the wagering game machine 102. As already described above in reference to FIGS. 2A-2B, PBIs 104*a*-130*a* facilitate independent addressing of and communication between components 104-130 in the wagering game machine 102 and external communication over communication network 134 and power line network 136.

Further with reference to FIG. 2C and as already described with reference to FIG. 1C, the peripheral interface 140 connects the peripheral devices 104-116 of the wagering game machine 102 to the PUP 118. The peripheral interface 138 may support a universal serial bus (USB) connection, FIREWIRE® connection (IEEE 1394), or wireless variants thereof (e.g., wireless USB) for interfacing the peripheral devices 104-116 to the PUP 118. Alternate connections now available (e.g., serial connection) or to be designed to connect to the peripheral devices 104-116 of the wagering game machine 102 may easily be implemented. The PUP 118 may be a plug-and-play device and the wagering game machine architecture 200*c* may support plug-and-play devices and hot-plugging, facilitating automatic recognition and connection of the PUP 118 during operation of the wagering game machine 102. The PUP 118 may also be communicatively connected to a communication network 134 and/or a power line network 136 to receive firmware updates from and transmit status updates to an update server. In addition, the PUP 118 may likewise use the communication network 134 and/or a power line network 136 to communicate with the CPU 124 of the wagering game machine 102, which may receive firmware updates and may then transmit the firmware updates to the PUP 118 to update one or more peripheral devices 104-116 of the wagering game machine 102. These processes of updating one or more peripheral devices 104-116 of the wagering game machine 102 are described in greater detail below with reference to FIGS. 8 and 9.

Figure 3:
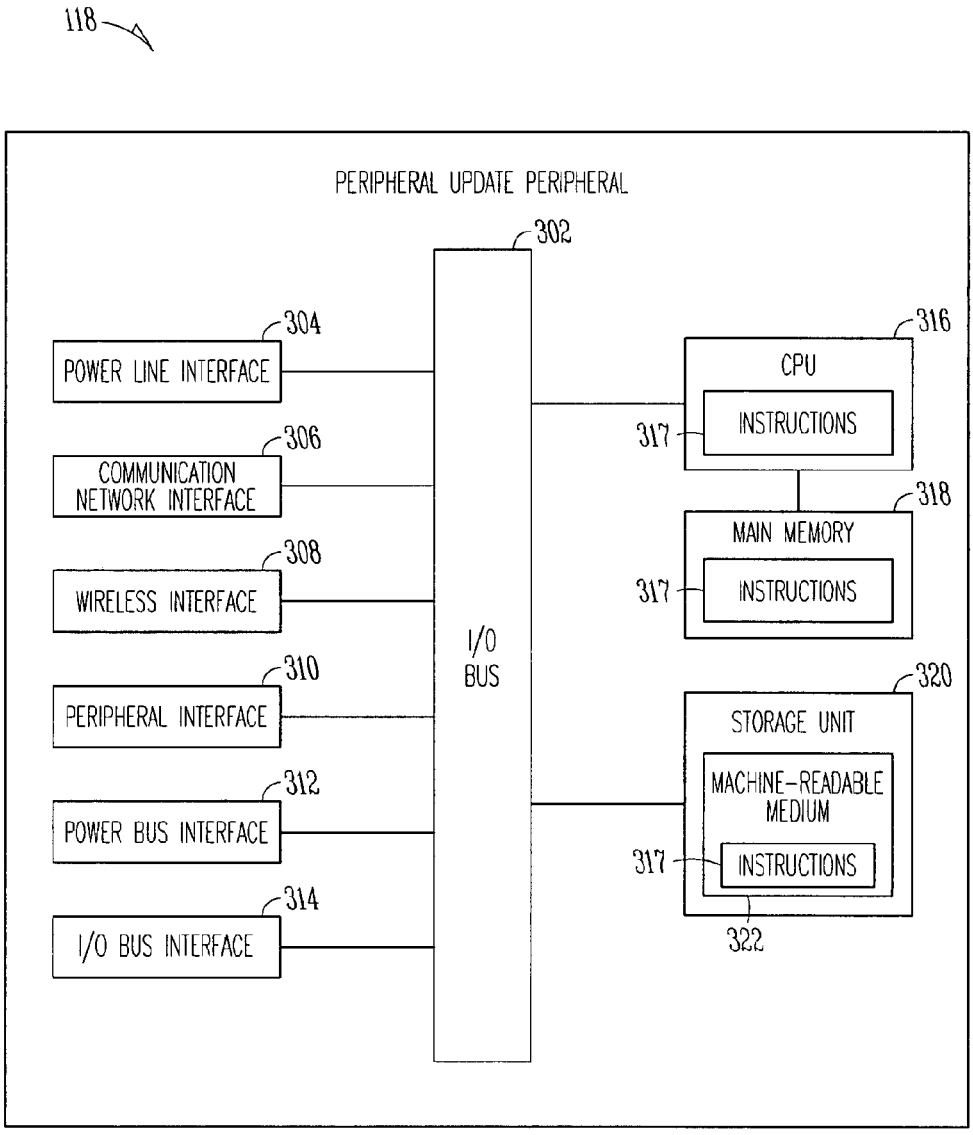
FIG. 3 is a block diagram illustrating an example peripheral update peripheral adapted to update one or more peripheral devices of a wagering game machine in accordance with FIGS. 1A-2C.

FIG. 3 is a block diagram illustrating an example peripheral update peripheral (PUP) 118 adapted to update one or more peripheral devices 104-116 of a wagering game machine 102 in accordance with FIGS. 1A-2C. The PUP 118 includes a central processing unit (CPU) 316 for receiving and performing firmware updates of the one or more peripheral devices 104-116 of the wagering game machine 102. The CPU 316 is communicatively connected to a memory 318 that may store all or a part of a firmware update for execution by the CPU 316 and a storage unit 320 that may store one or more firmware updates. The CPU 316 is further communicatively connected to an input/output (I/O) bus 302, which facilitates communication between the CPU 316 and the other components of the PUP 118. More particularly, the I/O bus 302 is communicatively connected to a power line interface 304, a communication network interface 306, a wireless interface 308, a peripheral interface 310, a power bus interface 312 and I/O bus interface 314 and storage unit 320.

Further with reference to FIG. 3, the power line interface 304 interfaces the PUP 118 to the power line network 136 (FIG. 4), facilitating communication of the PUP 118 over the power line network 136. The communication network interface 306 interfaces the PUP 118 to the communication network 134 (FIG. 4), facilitating communication of the PUP 118 over the communication network 134. The wireless interface 308 interfaces the PUP 118 to a wireless access point (FIG. 4), facilitating communication of the PUP 118 over the communication network 134. The peripheral interface 310 interfaces the PUP 118 to peripheral interface 138 or 140 (FIGS. 1B-1C and 2B-2C), facilitating communication of the PUP 118 to the peripherals devices 104-116. The power bus interface 312 interfaces the PUP 118 to the PBI 118*a* (FIG. 2A), facilitating communication of the PUP 118 to the peripherals devices 104-116 over the power bus 142. The I/O bus interface 314 interfaces the PUP 118 to the peripherals devices 104-116 (FIG. 1A), facilitating communication of the PUP 118 to the peripherals devices 104-116 over the I/O bus 132.

Lastly with reference to FIG. 3, the PUP 118 also includes instructions 317 for causing the PUP 118 to perform any one or more of the methodologies described herein. Furthermore, the storage unit 320 includes a machine readable medium 322 on which there is stored one or more sets of instructions and/or data structures (e.g., software 317) embodying or utilized by any one or more of the methodologies described herein. The software 317 may also reside, completely or at least partially, within the memory 318 and/or within the CPU 316 during execution thereof by the PUP 118, the memory 318 and the CPU 316 also constituting machine-readable media. The software 317 may further be transmitted or received via interfaces 304-314.

Figure 4:
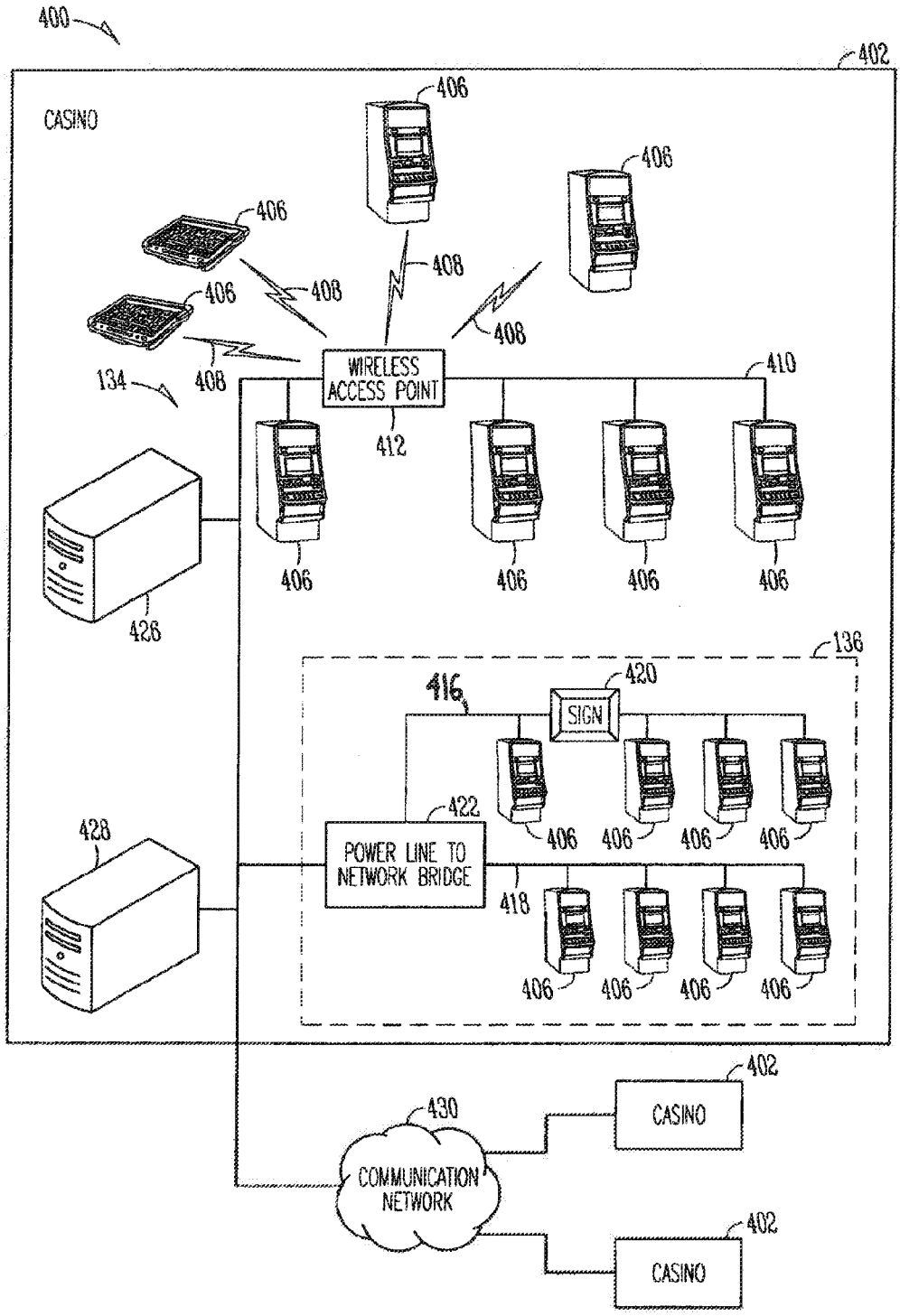
FIG. 4 is diagram illustrating an example wagering game network adapted for updating one or more peripheral devices of a wagering game machine in accordance with FIGS. 1A-3.

FIG. 4 is a block diagram illustrating an example wagering game network 400 adapted for updating one or more peripheral devices of a wagering game machine 406 in accordance with FIGS. 1A-3. The wagering game network 400 may include a plurality of casinos 402 communicatively connected to a communications network 430. The communication network 430 may be any conventional network, including the Internet, Wide Area Network (WAN), Metropolitan Area Network (MAN), Campus Area Network (CAN), Local Area Network (LAN), Home Area Network (HAN), wireless (802.11), satellite, as well as a variety of different combinations thereof. Each of the plurality of casinos 402 may include a communication network 134 (e.g., LAN) that may include a wireless access point 412, wagering game machines 406, a wagering game server 426 that may serve wagering games over the communication network 134 to the wagering game machines 406, and an update server 428 that may distribute firmware updates for updating the peripheral devices in the wagering game machines 406. Although only one wireless access point is depicted for clarity and brevity, it is to be noted that multiple wireless access points 412 may be provided. The communication network 134 includes wireless communication links 408 and wired communication links 410 providing connections to wagering game machines 406 over the communication network 134. The wired and wireless communication links 408, 410 may employ any suitable connection technology, such as wireless (802.11), Ethernet, public switched telephone networks (PSTN), and the like. The wagering game server 426 may serve wagering games and/or distribute content to wagering game machines located in other casinos 402 (or at other locations) communicatively connected via the communications network 430. Furthermore, the update server 428 may distribute firmware updates for updating peripheral devices in the wagering game machines 406 machines located in other casinos 402 (or at other locations) communicatively connected via the communications network 430.

Further with reference to FIG. 4, each of the plurality of casinos 402 may also include a power line network 136 that may include a plurality of wagering game machine banks 416, 418, which may be physical or logical banks. Each of the wagering game machine banks 416, 418 may include a plurality of wagering game machines 406 and electronic display signs 420 (although only one electronic display sign 420 is depicted for clarity and brevity) communicatively connected by the power line network 136. The power line network 136 further includes a power line to network bridge 422, which interconnects the power line network 136 to the communication network 134. As described with reference to reference to FIGS. 1A-3, the wagering game machines 406 (wagering game machine 102 in FIGS. 1A-2C) and the peripheral update peripheral (PUP) 118 (FIG. 3) are enabled to communicate over the communication network 134 and the power line network 136. More specifically, the wagering game server 426 may serve wagering games over the communication network 134 and the power line network 136 to the wagering game machines 406 communicatively connected to the power line network 136, and the update server 428 may likewise distribute firmware updates for updating the peripheral devices (peripheral device 104-116 in FIGS. 1A-2C) in the wagering game machines 406 communicatively connected to the power line network 136. Additionally, communication over the wagering game machine banks 416, 418 of the power line network 136 may also include display or control signals from the wagering game machines 406 for controlling the electronic display sign 420. It is to be noted that the wagering game machines 406, the wagering game server 426 and the update server 428 may include hardware and machine-readable media including instructions for performing the operations described herein.

Still further with reference to FIG. 4, the wagering game machines 406 described hereinabove may take any suitable form, such as floor standing models, handheld mobile units, bartop models, workstation-type console models, and the like. Further, the wagering game machines 406 may be primarily dedicated for use in conducting wagering games, or may include non-dedicated devices, such as mobile phones, personal digital assistants, personal computers, and the like. The wagering game network 400 may also include other network devices, such as accounting servers, wide area progressive servers, player tracking servers, and/or other devices suitable for use in connection with the example embodiments herein.

The communication between the wireless access point 412, wagering game machines 406 and the peripheral update peripheral 118 may use orthogonal frequency division multiplexed (OFDM) communication signals over a multicarrier communication channel. The multicarrier communication channel may be within a predetermined frequency spectrum and may include a plurality of orthogonal subcarriers. The multicarrier signals may be defined by closely spaced OFDM subcarriers. Each subcarrier may have a null at substantially a center frequency of the other subcarriers and/or each subcarrier may have an integer number of cycles within a symbol period. The wireless access point 412 and wagering game machines 406 may communicate in accordance with a broadband multiple access technique, such as orthogonal frequency division multiple access (OFDMA). The wireless access point 412 and wagering game machines 406 may also communicate using spread-spectrum signals.

The wireless access point 412 may also be part of a communication station, such as wireless local area network (WLAN) communication station including a Wireless Fidelity (WiFi) communication station, or a WLAN access point (AP). In this case, the wagering game machines 406 may be part of a mobile station, such as WLAN mobile station or a WiFi mobile station.

The wireless access point 412 may also be part of a broadband wireless access (BWA) network communication station, such as a Worldwide Interoperability for Microwave Access (WiMax) communication station, as the wireless access point 412 may be part of almost any wireless communication device. In this case, the wagering game machines 406 and the peripheral update peripheral 118 may also be part of a BWA network communication station, such as the WiMax communication station.

Any of the wagering game machines 406 may be part of a portable wireless communication device, such as a personal digital assistant (PDA), a laptop or portable computer with wireless communication capability, a web tablet, a wireless telephone, a wireless headset, a pager, an instant messaging device, a digital camera, a television, a medical device (e.g., a heart rate monitor, a blood pressure monitor, and the like), or any other device that may receive and/or transmit information wirelessly.

Furthermore, the frequency spectrums for the communication signals transmitted and received by the wireless access point 412, the wagering game machines 406 and the peripheral update peripheral 118 may include a 5 gigahertz (GHz) frequency spectrum, a 2.4 GHz frequency spectrum, or any other suitable frequency spectrum. More specifically, the 5 GHz frequency spectrum may include frequencies ranging from approximately 4.9 GHz to 5.9 GHz, and the 2.4 GHz spectrum may include frequencies ranging from approximately 2.3 GHz to 2.5 GHz. In some BWA networks, the frequency spectrum for the communication signals may include frequencies between approximately 2 GHz and 11 GHz.

The wireless access point 412, the wagering game machines 406 and the peripheral update peripheral may also communicate via radio frequency (RF) signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they may also be suitable to transmit and/or receive communications in accordance with other techniques and standards. In some BWA networks, the wireless access point 412, the wagering game machines 406 and the peripheral update peripheral may communicate RF signals in accordance with the IEEE 802.16-2004 and the IEEE 802.16(e) standards for wireless metropolitan area networks (WMANs) including variations and evolutions thereof. However, they may also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," Can 2005 and related amendments/versions.

The wireless access point 412 and the wagering game machines 406 may include one or more antennas (not shown). These antennas may include directional or omnidirectional antennas, including, for example, dipole antennas, monopole antennas, patch antennas, loop antennas, microstrip antennas or other types of antennas suitable for transmission of the RF signals. In multiple-input, multiple-output (MIMO) scenarios, two or more antennas may be used. However, instead of two or more antennas, a single antenna with multiple apertures may be used. Each aperture may be considered a separate antenna. In some multi-antenna scenarios, each antenna may be effectively separated to take advantage of spatial diversity and the different channel characteristics that may result between each of the antennas and another wireless communication device. In some other multi-antenna scenarios, the antennas of a device may be separated by up to 1/10 of a wavelength or more.

Handoffs between different wireless access points 412 and a wagering game machine 406 or a peripheral update peripheral 118 may be performed based on a signal-to-noise ratio (SNR), a signal-to-noise and interference ratio (SNIR), a bit-error rate (BER), or an energy per received bit.

The wireless access point 412, the wagering game machines 406 and the peripheral update peripheral 118 may communicate in accordance with standards such as the Pan-European mobile system standard referred to as the Global System for Mobile Communications (GSM). The wireless access point 412, the wagering game machines 406 and the peripheral update peripheral 118 may also communicate in accordance with packet radio services such as the General Packet Radio Service (GPRS) packet data communication service. The wireless access point 412, the wagering game machines 406 and the peripheral update peripheral 118 may further communicate in accordance with the Universal Mobile Telephone System (UMTS) for the next generation of GSM, which may, for example, implement communication techniques in accordance with 2.5G and third generation (3G) wireless standards (See 3GPP Technical Specification, Version 3.2.0, March 2000). The wireless access point 412, the wagering game machines 406 and the peripheral update peripheral 118 may provide packet data services (PDS) utilizing packet data protocols (PDP). The wireless access point 412, the wagering game machines 406 and the peripheral update peripheral may communicate in accordance with other standards or other air-interfaces including interfaces compatible with the enhanced data for GSM evolution (EDGE) standards (see 3GPP Technical Specification, Version 3.2.0, March 2000).

The wireless access point 412, the wagering game machines 406 and the peripheral update peripheral 118 may communicate in accordance with a short-range wireless standard, such as the BLUETOOTH® short-range digital communication protocol. BLUETOOTH® wireless technology is a de facto standard, as well as a specification for small-form factor, low-cost, short-range radio links between mobile PCs, mobile phones and other portable devices. (BLUETOOTH® is a trademark owned by Bluetooth SIG, Inc.) The wireless access point 412, the wagering game machines 406 and the peripheral update peripheral 118 may communicate in accordance with an ultra-wideband (UWB) communication technique where a carrier frequency is not used. The wireless access point 412, the wagering game machines 406 and the peripheral update peripheral 118 may communicate in accordance with an analog communication technique. The wireless access point 412, the wagering game machines 406 and the peripheral update peripheral may communicate in accordance with an optical communication technique, such as the Infrared Data Association (IRDA) standard. Lastly, the wireless access point 412, the wagering game machines 406 and the peripheral update peripheral 118 may communicate in accordance with the Home-RF standard which may be in accordance with a Home-RF Working Group (HRFWG) standard.

Figure 5:
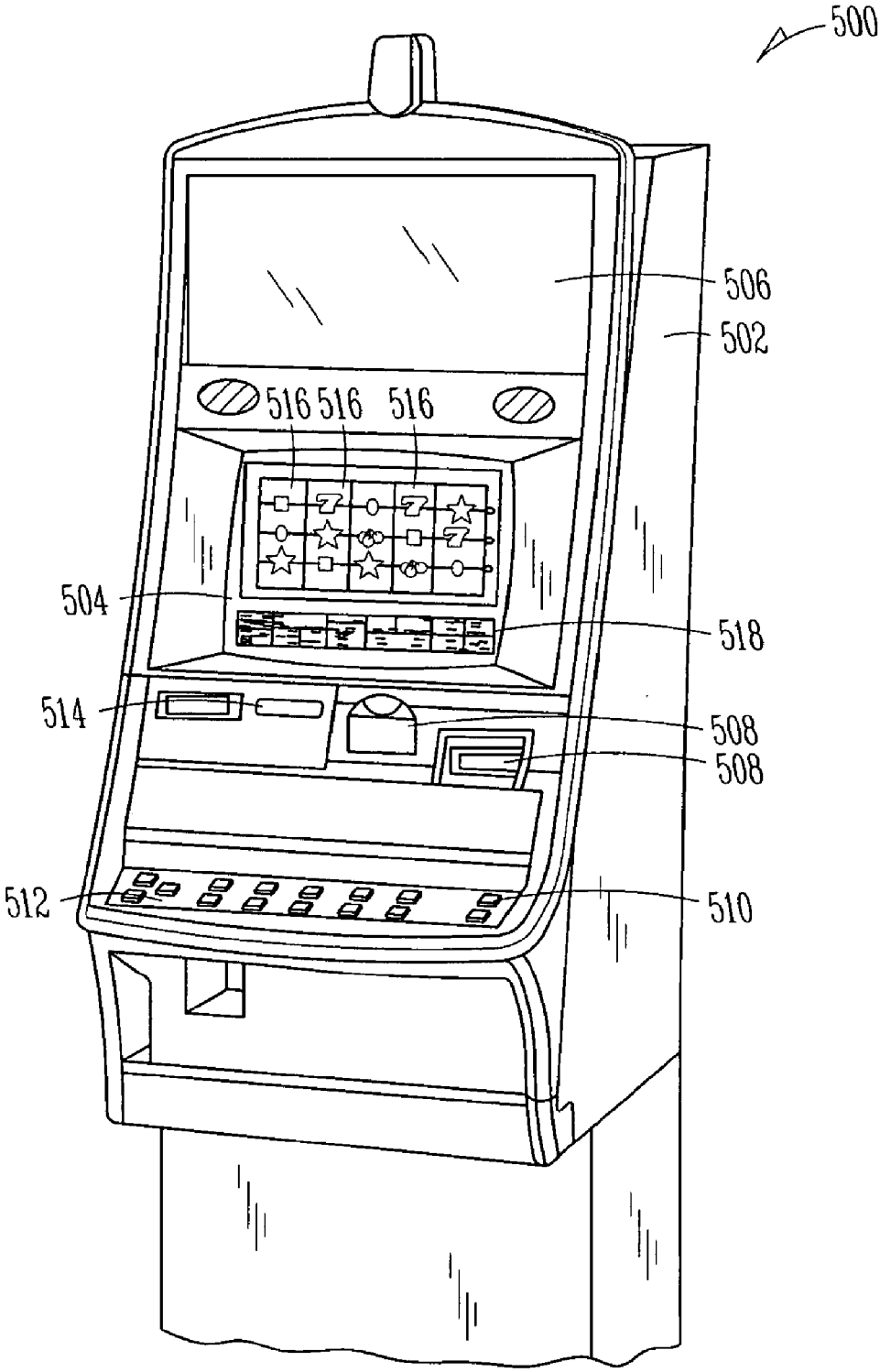
FIG. 5 is an embodiment of an example wagering game machine in accordance with FIGS. 1A-4.

FIG. 5 is an embodiment of an example wagering game machine 500 in accordance with FIGS. 1A-4. More specifically, FIG. 5 depicts is a perspective view of a wagering game machine 500. The wagering game machine 500 is used in gaming establishments, such as casinos 402. The wagering game machine 500 may be any type of a wagering game machine and may have varying structures and methods of operation. For example, the wagering game machine 500 may be an electromechanical wagering game machine configured to play mechanical slots, or it may be an electronic wagering game machine configured to play video casino games, such as blackjack, slots, keno, poker, blackjack, roulette, and the like. The wagering game machine 500 includes a housing 502 and includes input devices, including value input devices 508 and a player input device 510. For output, the wagering game machine 500 includes a primary display 504 for displaying information about a basic wagering game. The primary display 504 may also display information about a bonus wagering game and a progressive wagering game. The wagering game machine 500 also includes a secondary display 506 for displaying wagering game events, wagering game outcomes, and/or signage information. While some components of the wagering game machine 500 are described herein, numerous other elements may exist and may be used in any number or combination to create varying forms of the wagering game machine 500.

Further with reference to FIG. 5, the value input devices 508 may take any suitable form and may be located on the front of the housing 502. The value input devices 508 may receive currency and/or credits inserted by a player. The value input devices 508 may include coin acceptors for receiving coin currency and bill acceptors for receiving paper currency. Furthermore, the value input devices 508 may include ticket readers or barcode scanners for reading information stored on vouchers, cards, or other tangible portable storage devices. The vouchers or cards may authorize access to central accounts, which may transfer money to the wagering game machine 500. The player input device 510 includes a plurality of push buttons on a button panel 512 for operating the wagering game machine 500. In addition, or alternatively, the player input device 510 may include a touch screen 518 mounted over the primary display 504 and/or secondary display 506. The various components of the wagering game machine 500 may be connected directly to, or contained within, the housing 502. Alternatively, some of the wagering game machine's components may be located outside of the housing 502, while being communicatively coupled with the wagering game machine 500 using any suitable wired or wireless communication technology. The wagering game machine 500 may also include an information reader 514, which may include a card reader, ticket reader, bar code scanner, RFID transceiver, or computer readable storage medium interface. The information reader 514 may be used to award complimentary services, restore game assets, track player habits, and the like.

Still further with reference to FIG. 5, the operation of the basic wagering game may be displayed to the player on the primary display 504. The primary display 504 may also display a bonus game associated with the basic wagering game. The primary display 504 may include a cathode ray tube (CRT), a high resolution liquid crystal display (LCD), a plasma display, light emitting diodes (LEDs), or any other type of display suitable for use in the wagering game machine 500. Alternatively, the primary display 504 may include a number of mechanical reels to display the outcome. In FIG. 5, the wagering game machine 500 is an "upright" version in which the primary display 504 is oriented vertically relative to the player. The wagering game machine may also be a "slant-top" version in which the primary display 504 is slanted at about a thirty-degree angle toward the player of the wagering game machine 500. It is to be noted that the wagering game machine 500 may exhibit any suitable form factor, such as a free standing model, bartop model, mobile handheld model, workstation console model, and the like.

Finally with reference to FIG. 5, a player begins playing a basic wagering game by making a wager via the value input device 508. The player may initiate play by using the player input device's buttons or touch screen 518. The basic game may include arranging a plurality of symbols along a payline 516, which indicates one or more outcomes of the basic game. Such outcomes may be randomly selected in response to player input. At least one of the outcomes, which may include any variation or combination of symbols, may trigger a bonus game.

Figure 6:
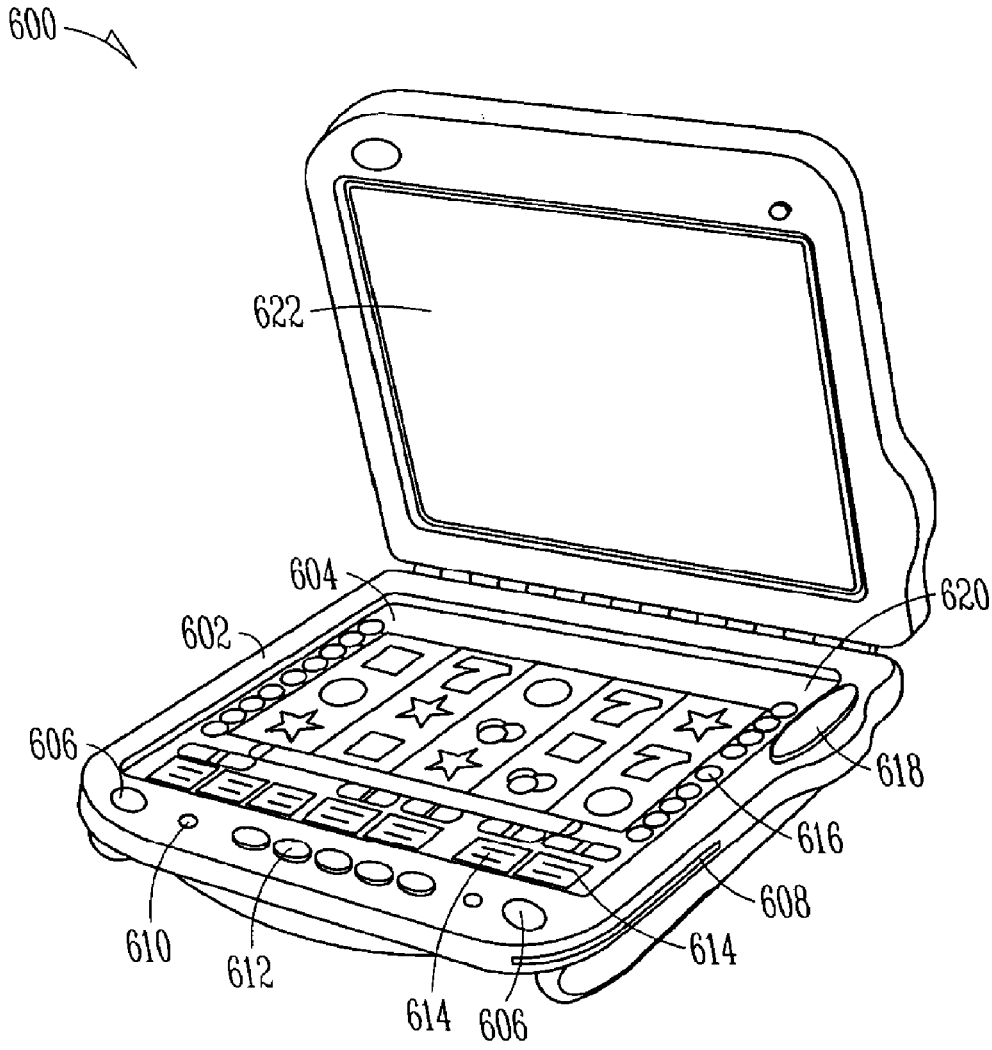
FIG. 6 is an embodiment of an example portable wagering game machine in accordance with FIGS. 1A-4.

FIG. 6 is an embodiment of a an example portable wagering game machine 600 in accordance with FIGS. 1A-4. Like the free-standing wagering game machine described with reference to FIG. 5 hereinabove, in a handheld or mobile form, the wagering game machine 600 may include any suitable electronic device configured to play video casino games such as blackjack, slots, keno, poker, blackjack, roulette, and the like. The wagering game machine 600 includes a housing 602 and includes input devices, including a value input device 608 and a player input device 612. For output, the wagering game machine 600 includes a primary display 604, a secondary display 622, one or more speakers 606, one or more player-accessible ports 610 (e.g., an audio output jack for headphones, a video headset jack, and the like), and other conventional I/O devices and ports, which may or may not be player-accessible. The secondary display 622 may be rotatable, fixed, movable, and/or detachable/attachable relative to the primary display 604. Either the primary display 604 and/or secondary display 622 may be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

Further with reference to FIG. 6, the player-accessible value input device 608 may include, for example, a slot located on the front, side, or top of the housing 602 configured to receive credit from a stored-value card (e.g., casino card, smart card, debit card, credit card, and the like) inserted by a player. The player-accessible value input device 608 may also include a sensor (e.g., an RF sensor) configured to sense a signal (e.g., an RF signal) output by a transmitter (e.g., an RF transmitter) carried by a player. The player-accessible value input device 608 may also or alternatively include a ticket reader, or barcode scanner, for reading information stored on a credit ticket, a card, or other tangible portable credit or funds storage device. The credit ticket or card may also authorize access to a central account, which may transfer money to the wagering game machine 600. Still other player-accessible value input devices 608 may require the use of touch keys 614 on the touch-screen display (e.g., primary display 604 and/or secondary display 622) or player input devices 612. Upon entry of player identification information and, preferably, secondary authorization information (e.g., a password, PIN number, stored value card number, predefined key sequences, and the like), the player may be permitted to access a player's account. As one potential optional security feature, the wagering game machine 600 may be configured to permit a player to only access an account the player has specifically set up for the wagering game machine 600. Other conventional security features may also be utilized to, for example, prevent unauthorized access to a player's account, to minimize an impact of any unauthorized access to a player's account, or to prevent unauthorized access to any personal information or funds temporarily stored on the wagering game machine 600.

Still further with reference to FIG. 6, the player-accessible value input device 608 may itself include or utilize a biometric player information reader which permits the player to access available funds on a player's account, either alone or in combination with another of the aforementioned player-accessible value input devices 608. Transactions such as an input of value to the wagering game machine 600, a transfer of value from one player account or source to an account associated with the wagering game machine 600, or the execution of another transaction, for example, may all be authorized by one or more biometric readings from the biometric device. Alternatively, to enhance security, a transaction may be optionally enabled only by a two-step process in which a secondary source confirms the identity indicated by a primary source. For example, a player-accessible value input device 608 including the biometric player information reader may require a confirmatory entry from another biometric player information reader 618, or from another source, such as a credit card, debit card, player ID card, fob key, PIN number, password, hotel room key, and the like. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, and the like) may be utilized to provide enhanced security prior to the electronic transfer of any funds. In another aspect, the value input device 608 may be provided remotely from the wagering game machine 600.

Yet further with reference to FIG. 6, the player input device 612 includes a plurality of push buttons on a button panel for operating the wagering game machine 600. In addition, or alternatively, the player input device 612 may include a touch screen mounted to the primary display 604 and/or the secondary display 622. In one aspect, the touch screen is matched to a display screen having one or more selectable touch keys 614 selectable by a user's touching of the associated area of the screen using a finger or a tool, such as a stylus pointer. A player enables a desired function either by touching the touch screen at an appropriate touch key 614 or by pressing an appropriate push button on the button panel. The touch keys 614 may be used to implement the same functions as push buttons. Alternatively, the push buttons may provide inputs for one aspect of the operating the game, while the touch keys 614 may allow for input needed for another aspect of the game. The various components of the wagering game machine 600 may be connected directly to, or contained within, the housing 602, or may be located outside the housing 602 and connected to the housing 602 via a variety of wired (tethered) or wireless connection methods. Thus, the wagering game machine 600 may include a single unit or a plurality of interconnected (e.g., wireless connections) parts which may be arranged to suit a player's preferences.

Additionally with reference to FIG. 6, the operation of the basic wagering game on the wagering game machine 600 is displayed to the player on the primary display 604. The primary display 604 may also display the bonus game associated with the basic wagering game. The primary display 604 may be a high resolution liquid crystal display (LCD), a plasma display, a light emitting diode (LED) display, or any other type of display suitable for use in the wagering game machine 600. The size of the primary display 604 may vary from, for example, about a 2-3" display to a 15" or 17" display. The primary display 604 may be a 7"-10" display. Optionally, coatings or removable films or sheets may be applied to the display to provide desired characteristics (e.g., anti-scratch, anti-glare, bacterially-resistant and anti-microbial films, and the like). The primary display 604 and/or secondary display 622 may have a 16:9 aspect ratio or another aspect ratio (e.g., 4:3). It is to be noted that the primary display 604 and/or secondary display 622 may each have different resolutions, different color schemes, and different aspect ratios.

Finally with reference to FIG. 6, as with the free standing embodiments of the wagering gaming machine 500 of FIG. 5, a player begins play of the basic wagering game on the wagering game machine 600 by making a wager (e.g., via the value input device 608 or an assignment of credits stored on the handheld gaming machine via the touch screen keys 614, player input device 612, or buttons) on the wagering game machine 600. The basic game may comprise a plurality of symbols arranged in an array, and includes at least one payline 616 that indicates one or more outcomes of the basic game. Such outcomes may be randomly selected in response to the wagering input by the player. At least one of the plurality of randomly selected outcomes may be a start-bonus outcome, which may include any variations of symbols or symbol combinations triggering a bonus game. The player-accessible value input device 608 of the wagering game machine 600 may double as a player information reader 618 that allows for identification of a player by reading a card with information indicating the player's identity (e.g., reading a player's credit card, player ID card, smart card, and the like). The player information reader 618 may alternatively or also include a bar code scanner, RFID transceiver or computer readable storage medium interface. The player information reader 618 may also include a biometric sensing device.

Figure 7A:
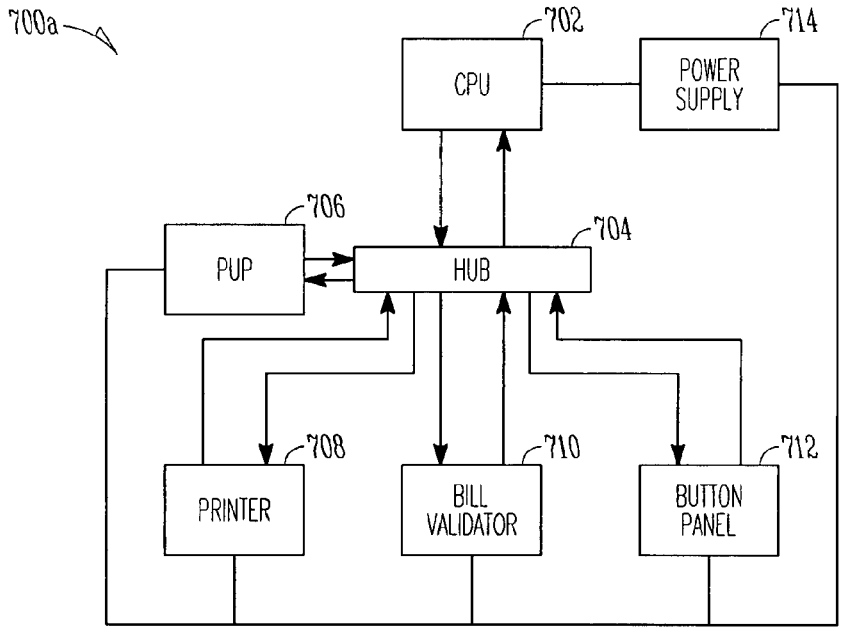
FIGS. 7A-7B are block diagrams illustrating embodiments of example fiber optic peripheral connection topologies, including connection of the peripheral update peripheral of FIG. 3.
Figure 7B:
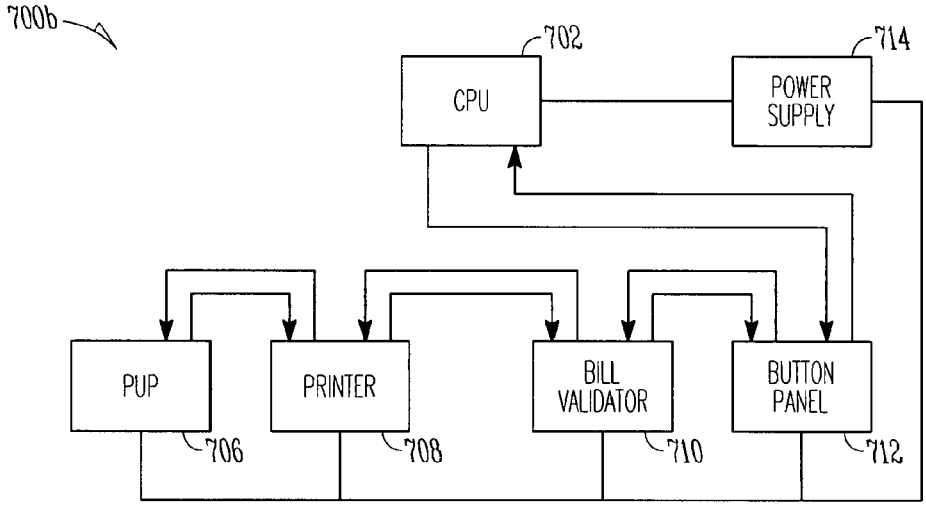

FIGS. 7A-7B are block diagrams illustrating embodiments of example fiber optic peripheral connection topologies 700*a* and 700*b*, including the connection of the peripheral update peripheral (PUP) 118 of FIG. 3. More specifically, FIG. 7A is a block diagram illustrating an example fiber optic hub topology 700*a*. In the hub topology 700*a*, the peripheral devices 706-712 are communicatively connected the CPU 702 via a hub 704. It is noted that different, additional or fewer peripheral devices may be provided than illustrated in the example hub topology 700*a*. The communication between the CPU 702 and each of the peripheral devices 706-712 is accomplished via the hub 704. Power supply 714 provides power to the CPU 702 and the peripheral devices 706-712. Unidirectional fiber optic cables may be used to transmit and receive communication between the CPU 702 and the hub 704 and between the hub 704 and each of the peripheral devices 706-712. Alternatively, bidirectional fiber optic cables may be used to transmit and receive communication between the CPU 702 and the hub 704 and between the hub 704 and each of the peripheral devices 706-712.

FIG. 7B is block diagram illustrating an example fiber optic daisy chain topology 700*b*. In the daisy chain topology 700*b*, the CPU 702 is communicatively connected to peripheral device 712, which is in turn communicatively connected to peripheral device 710. Peripheral device 710 is communicatively connected to peripheral deice 708, which is in turn communicatively connected to peripheral device 706. It is noted that different, additional or fewer peripheral devices may be provided than illustrated in the daisy chain topology 700*b*. The daisy chain topology provides for pass thru communication between the CPU 702 and each of the peripheral devices 706-712. The power supply 714 provides power to the CPU 702 and the peripheral devices 706-712. Unidirectional fiber optic cables may be used to transmit and receive communication between the CPU 702 and the peripheral devices 706-712. Alternatively, bidirectional fiber optic cables may be used to transmit and receive communication between the CPU 702 and the peripheral devices 706-712.

Figure 7C:
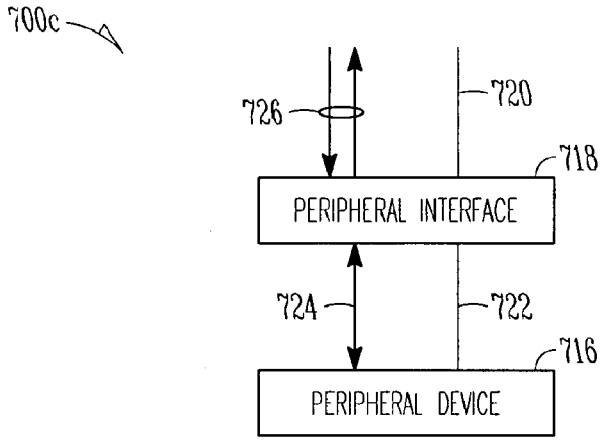
FIG. 7C is a block diagram illustrating an example interface adapted to interface a peripheral device in the peripheral connection topologies described of FIGS. 7A and 7B.

FIG. 7C is block diagram illustrating an example interface 700*c* adapted to interface a peripheral device 716 in the peripheral connection topologies 700*a* and 700*b* described above in FIGS. 7A and 7B, respectively. A peripheral interface 718 may be provided, which communicatively connects to the peripheral device 716 (e.g., any peripheral device 706-712 or CPU 702) to allow the peripheral device 716 (or CPU) to communicate using the fiber optic connections depicted and described with reference to FIGS. 7A-7B. The peripheral device 716 is communicatively connected to the peripheral interface 718 via a bidirectional electrical data connection 724. The peripheral interface 718 is adapted to convert communication to and from the peripheral device 716 via connection 724 for transmission/reception via the unidirectional fiber optic cables 726 or via a bidirectional fiber optic cable (not shown). Primary power connection 720 may be communicatively connected to the peripheral interface 716 and distributed to the peripheral device 716 via power connection 722. Alternate power configurations are also possible.

Figure 8:
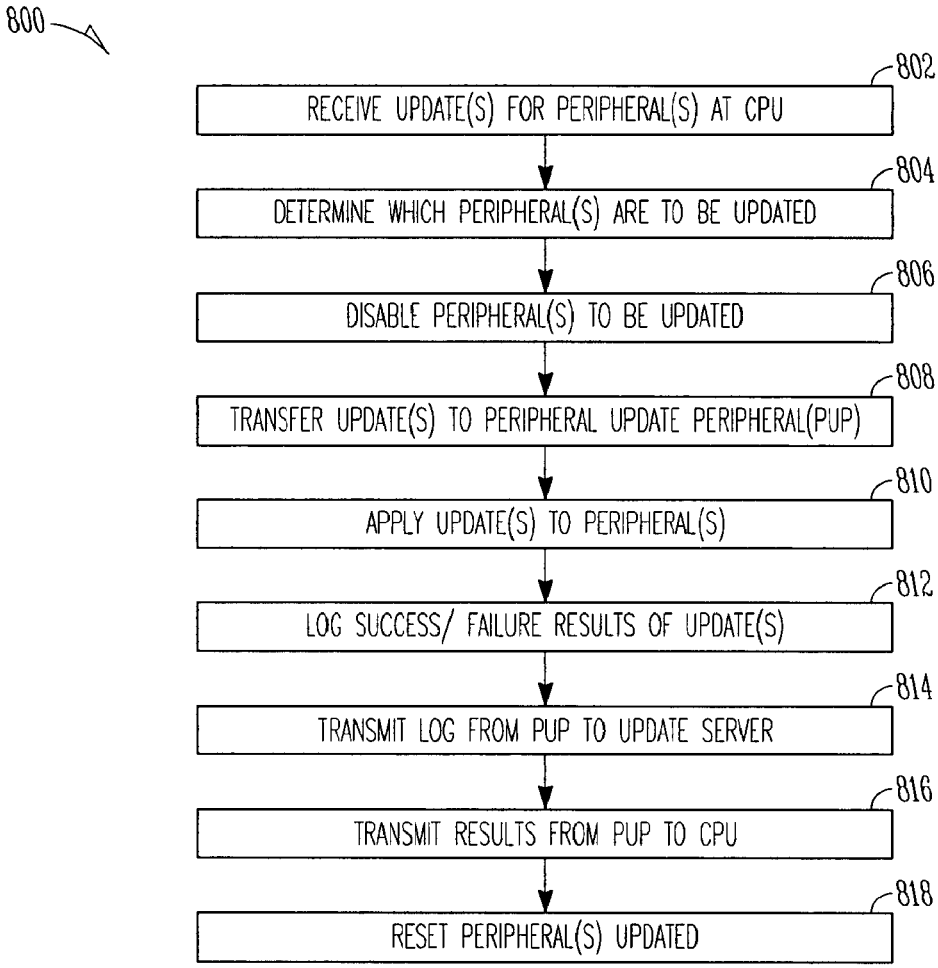
FIG. 8 is an embodiment of an example flowchart for updating one or more peripheral devices of a wagering game machine in accordance with FIGS. 1A-4.

FIG. 8 is a flowchart illustrating an example method 800 for updating one or more peripheral devices (e.g., peripheral devices 104-116, 706-712) of a wagering game machine (e.g., wagering game machine 102, 406) in accordance with FIGS. 1A-7C. At the outset and before describing the method 800 and as described in reference to FIG. 4 hereinabove, an update server (e.g., update server 428) may distribute to a particular wagering game machine one or more firmware updates for updating peripheral devices in the wagering game machine. Therefore, at operation 802, the CPU 124 of the particular wagering game machine receives the one or more firmware updates for updating peripheral devices in the wagering game machine. At operation 804, the CPU 124 determines which peripheral devices are to be updated. The determination of which peripheral devices are to be updated may be achieved in a variety ways. The peripheral device to be updated may be indicated in a header of a firmware update (e.g., firmware update file), may be encoded into the firmware update (e.g., encoded into a name of the firmware update file or the firmware update itself), or may be specified as part of an update protocol employed in the wagering game network 400 for updating peripheral devices.

Further with reference to FIG. 8, the determined peripheral devices are then disabled (e.g., set to a disabled state) by the CPU 124 at operation 806. The disabled state merely identifies a determined peripheral device as unavailable for a wagering game in a wagering game machine (e.g., wagering game machine 102, 406). However, the disabled peripheral device is operational and may be updated in accordance with FIG. 8. The disablement may involve the CPU 124 waiting until such time that the determined peripheral devices are not busy performing functions associated with a wagering game. Alternatively, the disablement may also involve the CPU 124 waiting until a wagering game that may be in progress finishes and a player cashes out before the wagering game machine (e.g., wagering game machine 102, 406) that includes the peripheral devices to be updated, is set into a game-disabled. At operation 808, the CPU 124 transmits the one or more firmware updates to the peripheral update peripheral (PUP) 118. At operation 810, the PUP applies the one or more firmware updates to the determined peripheral devices. It is noted that the PUP 118 may also determine which peripheral devices are to be updated in a similar fashion to the CPU 124 described above. Alternatively, the CPU 124, in addition to transmitting the firmware update, may also transmit the identification of the determined peripheral devices. If a firmware update is not applied successfully to a peripheral device at operation 810, the PUP 118 may retry the firmware update for a predetermined number of times. At operation 812, the PUP 118 may generate a log to record a success or failure result of applying each of the one or more updates. The PUP 118 may transmit the log to the update server for storage at operation 814. At operation 816, the PUP 118 transmits to the CPU 124 the success or failure result of applying each of the one or more updates. At operation 818, the CPU resets the peripheral devices (e.g., peripheral devices are set to enabled state) that were updated successfully.

Figure 9:
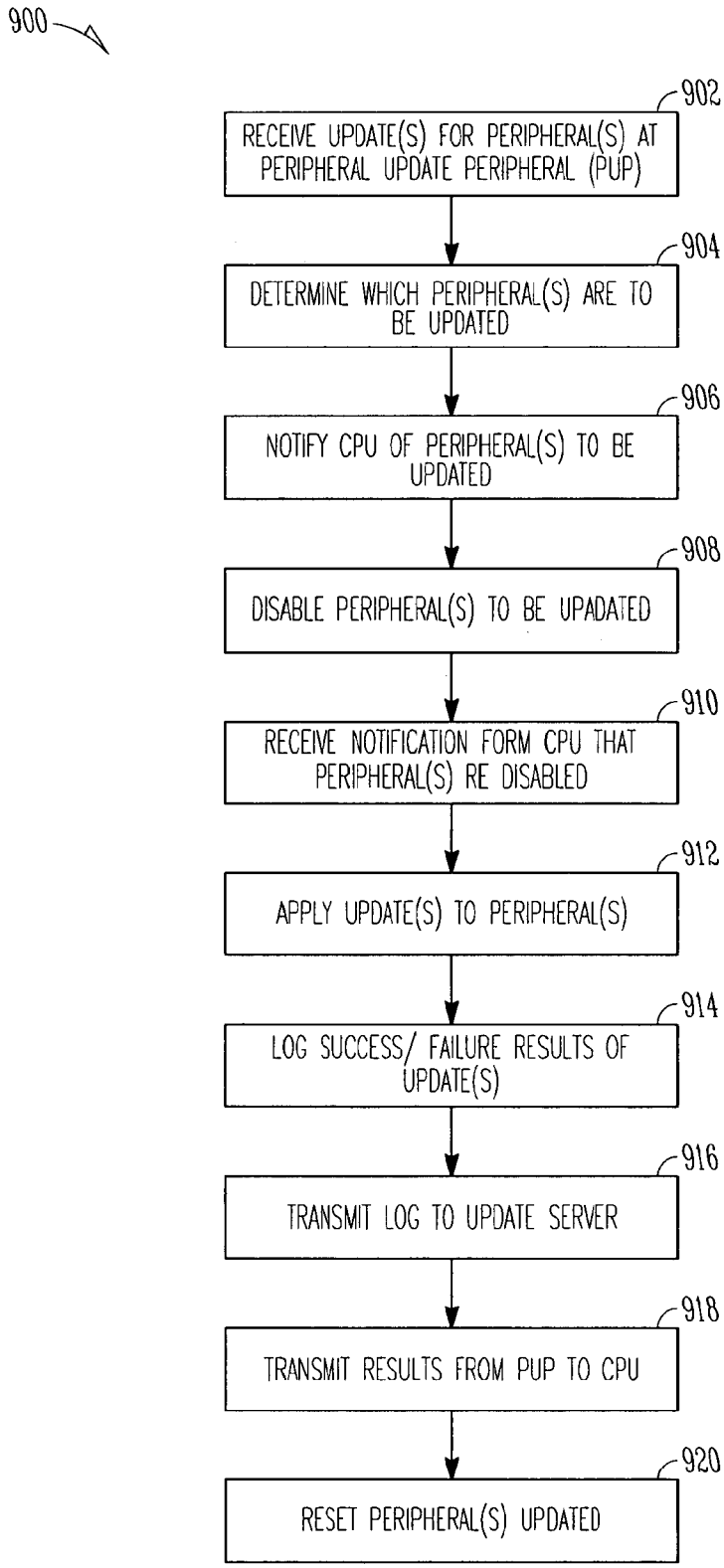
FIG. 9 is another embodiment of an example flowchart for updating one or more peripheral devices of a wagering game machine in accordance with FIGS. 1A-4.

FIG. 9 is a flowchart illustrating an example method 900 for updating one or more peripheral devices (e.g., peripheral devices 104-116, 706-712) of a wagering game machine (e.g., wagering game machine 102, 406) in accordance with FIGS. 1A-7C. At the outset and before describing the method 900 and as described in reference to FIG. 4 hereinabove, an update server (e.g., update server 428) may distribute to a peripheral update peripheral 118 one or more firmware updates for updating peripheral devices in a wagering game machine. Therefore, at operation 902, the PUP 118 receives the one or more firmware updates for updating one or more peripheral devices in the wagering game machine. At operation 904, the PUP 118 determines which peripheral devices are to be updated. As described in reference to FIG. 8 above, the peripheral device to be updated may be indicated in a header of a firmware update (e.g., firmware update file), may be encoded into the firmware update (e.g., encoded into a name of the firmware update file or the firmware update itself), or may be specified as part of an update protocol employed in the wagering game network 400 for updating peripheral devices. At operation 906, the PUP 118 notifies the CPU 124 of the determined peripheral device to be updated.

Further with reference to FIG. 9, the determined peripheral devices are the disabled (e.g., put into a disabled state) by the CPU 124 at operation 908. The disabled state merely identifies a determined peripheral device as unavailable for a wagering game in a wagering game machine (e.g., wagering game machine 102, 406). However, the disabled peripheral device is operational and may be updated in accordance with FIG. 9. As described in reference to FIG. 8, the disablement may involve disabling peripheral devices to be updated or disabling the wagering game machine that includes the peripheral device to be updated. At operation 910, the PUP 118 receives notification from the CPU 124 that the determined peripheral devices have been disabled. At operation 912, the PUP 118 applies the one or more updates to the determined peripheral devices. If a firmware update is not applied successfully to a peripheral device at operation 912, the PUP 118 may retry the firmware update for a predetermined number of times. At operation 914, the PUP 118 may generate a log to record a success or failure result of applying each of the one or more firmware updates. The PUP 118 transmits the log to the update server for storage at step 916. At operation 918, the PUP 118 transmits to the CPU 124 the success or failure result of applying each of the one or more updates. At operation 920, the CPU resets the peripheral devices that were successfully updated.

In the foregoing description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A peripheral update device configured to install a firmware update in a peripheral device connected to a gaming machine, the gaming machine including one or more display devices, a plurality of peripheral devices, one or more gaming processors and a gaming memory device storing gaming instructions that, when executed by at least one of the one or more game processors, cause the one or more game processors to operate with the one or more display devices to conduct a wagering game, the peripheral update device comprising:

one or more interfaces configured to communicate with the plurality of peripheral devices;

one or more update processors, the one or more update processors being independent of the one or more gaming processors; and an update memory device storing update instructions that, when executed by at least one of the one or more update processors, cause the peripheral update device to:

receive a firmware update data package including updated firmware for at least one of the plurality of peripheral devices, and install, via at least one of the one or more interfaces, the updated firmware in the at least one peripheral device.

2. The peripheral update device of claim 1, wherein the one or more interfaces connect to the plurality of peripheral devices via a power line interface communicably connected to the game machine through a power line network.

3. The peripheral update device of claim 1, wherein the one or more interfaces connect to the plurality of peripheral devices via a power bus interface communicably connected to a power bus of the game machine.

4. The peripheral update device of claim 1, wherein the firmware update package is received directly from an update server via a communications network.

5. The peripheral update device of claim 1, wherein the firmware update package is received through the gaming machine.

6. A gaming machine configured to install a firmware update in a peripheral device connected to the gaming machine, the gaming machine comprising:

one or more display devices configured to display images of a wagering game;

one or more input devices;

a plurality of peripheral devices;

one or more gaming processors;

a peripheral update device including one or more interfaces configured to communicate with the plurality of peripheral devices, one or more update processors that are independent of the one or more game processors, and an update memory device storing executable update instructions that, when executed by at least one of the one or more update processors, cause the peripheral device to:

receive a firmware update data package including updated firmware for at least one of the plurality of peripheral devices;

install, via at least one of the one or more interfaces, the updated firmware in the at least one peripheral device; and one or more gaming memory devices storing gaming instructions that, when executed by at least one of the one or more gaming processors, cause the gaming machine to:

display, via at least one of the one or more display devices, the wagering game;

randomly select, via at least one of the one or more gaming processors, a game outcome;

award an award in response to the game outcome being a winning outcome; and activate the at least one updated peripheral device in response to a request from at least one of the one or more gaming processors.

7. The gaming machine of claim 6, further comprising an input/output bus connected to the plurality of peripheral devices, and wherein the one or more interfaces connect to the plurality of peripheral devices via the input/output bus.

8. The gaming machine of claim 6, further comprising a power bus connected to the plurality of peripheral devices, and wherein the one or more interfaces connect to the plurality of peripheral devices via the power bus.

9. The gaming machine of claim 8, further comprising a power bus interface connecting at least one of the plurality of peripheral devices to the power bus for communication with the peripheral update device.

10. The gaming machine of claim 6, wherein the peripheral update device receives the firmware update package directly from an update server.

11. The gaming machine of claim 6, wherein the peripheral update device receives the firmware update package via the gaming machine.

12. The gaming machine of claim 11, wherein the gaming machine:

i) receives the firmware update package, ii) determines, via at least one or the one or more gaming processors, which of the plurality of peripheral devices will be updated by firmware in the firmware update package, iii) disables, via at least one of the one or more gaming processors, the peripheral devices designated for updating, and iv) transfers the firmware update package to the peripheral update device for installation.

13. The gaming machine of claim 6, wherein the peripheral update device comprises an internal component of the gaming machine.

14. The gaming machine of claim 6, wherein the peripheral update device is external to the gaming machine.

15. The gaming machine of claim 6, wherein the peripheral update device, prior to installing the updated firmware, further:

i) determines which peripheral devices will be updated by firmware in the firmware update package, ii) notifies at least one of the one or more gaming processors as to which of the plurality of peripheral devices will be updated by firmware in the firmware update package, and iii) receives notification that the designated peripheral devices have been disabled by at least one of the one of the one or more gaming processors.

16. A computer-implemented method of updating a peripheral device in a gaming machine via a peripheral update device, the gaming machine configured to conduct a wagering game, the peripheral update device including one or more update processors that are independent of the one or more gaming processors, and one or more interfaces connected for communication to a plurality of peripheral devices in the gaming machine, the method comprising:

executing, via at least one of the one or more update processors, stored update instructions that cause the peripheral update device to:

receive a firmware update package including updated firmware for at least one of the plurality of peripheral devices; and install, via at least one of the one or more interfaces, the updated firmware in the at least one peripheral device; and the method further comprising:

executing, via at least one of the one or more gaming processors, stored gaming instructions that cause the gaming machine to:

display, via one or more display devices, the wagering game;

randomly select a game outcome from a plurality of game outcomes;

award an award in response to the selected game outcome being a winning outcome; and activate the at least one updated peripheral device in response to a request from at least one of the one or more gaming processors.

17. The computer-implemented method of claim 16, wherein the peripheral update device receives the firmware update package directly from an update server via a communications network.

18. The computer-implemented method of claim 16, wherein the stored gaming instructions further cause the gaming machine to:

i) receive the firmware update package, ii) determine, via at least one or the one or more gaming processors, which of the plurality of peripheral devices will be updated by the firmware in the firmware update package, iii) disable, via at least one of the one or more gaming processors, the peripheral devices designated for updating, and iv) transfer the firmware update package to the peripheral update device for installation.

19. The computer-implemented method of claim 16, wherein the stored update instructions further cause the peripheral device, prior to installing the updated firmware, to:

i) determine which peripheral devices will be updated by the firmware in the firmware update package, ii) notify at least one of the one or more gaming processors as to which of the plurality of peripheral devices will be updated by firmware in the firmware update package, and iii) receive notification that the designated peripheral devices have been disabled by at least one of the one of the one or more gaming processors.

20. A machine-readable, non-transitory medium for updating a peripheral device in a gaming machine via a peripheral update device, the gaming machine including one or more gaming processors configured to conduct a wagering game on the gaming machine, a plurality of peripheral devices, and one or more memory devices storing gaming instructions, and the peripheral update device including one or more update processors, the one or more update processors being independent of the one or more gaming processors, and one or more interfaces connected for communication to the plurality of peripheral devices, the machine-readable medium including executable instructions that, when executed by one or more update processors, cause the peripheral update device to perform a method comprising:

receiving a firmware update package including updated firmware for at least one of the plurality of peripheral devices; and installing, via at least one of the one or more interfaces, the updated firmware in the at least one peripheral device.

21. The machine-readable medium of claim 20, wherein the medium resides on an update memory device within the peripheral update device.

22. The machine-readable medium of claim 20, wherein the medium resides on an update server, and wherein the update instructions are transmitted to the peripheral update device via a communications network.

23. The machine-readable medium of claim 20, wherein the medium and the peripheral update device both reside within the gaming machine.

* * * * *

UNITED STATES PATENT AND TRADEMARK OFFICE

CERTIFICATE OF CORRECTION

PATENT NO. : 8,409,009 B2
APPLICATION NO. : 12/304229
DATED : April 2, 2013
INVENTOR(S) : Motyl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1148 days.

Signed and Sealed this
First Day of September, 2015

Michelle K. Lee

Michelle K. Lee
*Director of the United States Patent and Trademark Office*